US012498189B2

(12) United States Patent
Giles et al.

(10) Patent No.: US 12,498,189 B2
(45) Date of Patent: Dec. 16, 2025

(54) DOUBLE STACK MAGAZINE FOR FIREARM

(71) Applicant: Sturm, Ruger & Company, Inc., Southport, CT (US)

(72) Inventors: Jacob Giles, Jerome, AZ (US); Brian Vuksanovich, Poland, OH (US); Heath Putnam, Chino Valley, AZ (US)

(73) Assignee: Sturm, Ruger & Company, Inc.

( * ) Notice: Subject to any disclaimer, the term of this patent is extended or adjusted under 35 U.S.C. 154(b) by 0 days.

(21) Appl. No.: 18/639,860

(22) Filed: Apr. 18, 2024

(65) Prior Publication Data

US 2024/0353192 A1 Oct. 24, 2024

Related U.S. Application Data

(60) Provisional application No. 63/497,083, filed on Apr. 19, 2023.

(51) Int. Cl.
*F41A 9/69* (2006.01)
*F41A 9/70* (2006.01)

(52) U.S. Cl.
CPC . *F41A 9/69* (2013.01); *F41A 9/70* (2013.01)

(58) Field of Classification Search
CPC ..... F41A 9/70; F41A 9/69; F41A 9/65; F41A 9/71; F41A 9/41; F41A 3/66; F41A 11/00; F41A 17/36; F41A 17/38
USPC ..... 42/50, 49.01, 6, 7; 89/33.1
See application file for complete search history.

(56) References Cited

U.S. PATENT DOCUMENTS

| | | | |
|---|---|---|---|
| 4,876,813 | A | 10/1989 | Tuma |
| 5,386,657 | A | 2/1995 | Racheli |
| 5,388,360 | A | 2/1995 | Fortunato |
| 5,755,052 | A | 5/1998 | Keeney |
| 8,042,297 | B2 | 10/2011 | Emde |

(Continued)

FOREIGN PATENT DOCUMENTS

| | | | |
|---|---|---|---|
| DE | 10111691 | A1 | 9/2002 |
| DE | 20300568 | U1 | 4/2003 |

(Continued)

OTHER PUBLICATIONS

International Application Status Report of PCT/US2024/025294, Issued Sep. 18, 2024.

*Primary Examiner* — Michael D David
(74) *Attorney, Agent, or Firm* — The Belles Group, P.C.

(57) ABSTRACT

A double stack magazine for a firearm comprises a tubular magazine body defining a cavity for holding a stack of cartridges, a spring, and a follower biased by the spring for dispensing cartridges from the magazine. The cartridges may be rimmed cartridges in one embodiment arranged in a vertically staggered side-to-side arrangement. The magazine includes a lower double stack section and upper single stack section. The follower includes angled front and rear cartridge feed surfaces each configured to exclusively engage the cartridge stack at alternate times depending on whether cartridges are present in the lower double stack section. The magazine further includes a pair of non-linear cartridge convergence ribs configured to engage the cartridge stack and force the projectile ends thereof together in the upper single stack section to center an uppermost cartridge in the stack for dispensing from the magazine to the firearm for chambering.

22 Claims, 26 Drawing Sheets

(56) References Cited

U.S. PATENT DOCUMENTS

| | | | | |
|---|---|---|---|---|
| 8,225,541 | B2 | 7/2012 | Bigley et al. | |
| 8,448,364 | B2 | 5/2013 | Davidson | |
| 8,776,419 | B2 | 7/2014 | Obermeit | |
| 8,850,732 | B2 * | 10/2014 | Zheng | F41A 9/70 42/49.02 |
| 8,863,422 | B2 | 10/2014 | Ballard | |
| 8,919,021 | B2 | 12/2014 | Pietrzyk et al. | |
| 8,943,727 | B2 | 2/2015 | Russell | |
| 9,228,788 | B1 | 1/2016 | Simon et al. | |
| 9,797,668 | B2 | 10/2017 | Hayes et al. | |
| 9,921,014 | B2 | 3/2018 | Dees | |
| 10,480,880 | B2 | 11/2019 | Thomele et al. | |
| 10,619,959 | B1 | 4/2020 | Loveday et al. | |
| 10,655,924 | B2 | 5/2020 | Coombs et al. | |
| 10,718,582 | B2 | 7/2020 | Sharkov et al. | |
| 10,816,289 | B2 | 10/2020 | Davidson | |
| 11,035,635 | B2 | 6/2021 | Bubits et al. | |
| 11,105,574 | B1 | 8/2021 | Crye | |
| 11,287,202 | B2 | 3/2022 | Werner et al. | |
| 2013/0167420 | A1 | 7/2013 | Zheng | |
| 2013/0247437 | A1 * | 9/2013 | Obermeit | F41A 9/69 42/49.01 |
| 2015/0075050 | A1 * | 3/2015 | Hayes | F41A 9/70 42/50 |
| 2020/0011623 | A1 * | 1/2020 | Kramer | F41A 9/69 |
| 2020/0011625 | A1 | 1/2020 | Kramer | |
| 2021/0123698 | A1 | 4/2021 | Zeider et al. | |
| 2021/0270554 | A1 | 9/2021 | Bubits | |
| 2021/0389068 | A1 | 12/2021 | Philbin et al. | |
| 2024/0353192 | A1 * | 10/2024 | Giles | F41A 9/69 |

FOREIGN PATENT DOCUMENTS

| | | |
|---|---|---|
| GB | 275606 | 10/1927 |
| WO | 2015/030695 A1 | 3/2015 |

* cited by examiner

DOUBLE STACK MAGAZINE FOR FIREARM

CROSS-REFERENCE TO RELATED APPLICATIONS

The present application claims the benefit of priority to U.S. Provisional Application No. 63/497,083 filed Apr. 19, 2023, which is incorporated herein by reference in its entirety.

BACKGROUND

The present invention generally relates to firearms, and more particularly to ammunition magazines detachably mountable to firearms for holding and dispensing a stack of cartridges.

Ammunition magazines for firearms are designed to conveniently store and feed multiple rounds of shells or cartridges. Such magazines have a spring feed mechanism which automatically dispenses the cartridges into the firearm for firing and are used in many different types of firearms, including rifles (including carbines with shortened barrels), and pistols. One type of magazine used is a box style magazine, which may be removably detached to the firearm action. These magazines hold a plurality of stacked cartridges. When the action is cycled and the spent shell or cartridge casing is extracted from the chamber and ejected, a fresh cartridge is automatically moved by the spring mechanism into the breech area of the firearm from which the movable bolt or breech block loads the cartridge into the chamber of the barrel for firing.

The projected three-dimensional outer profile or envelope approximated by a particular cartridge determines how tightly and closely multiple cartridges can be stacked inside the case or tube of a box-type magazine. Recent trends in the firearms market show consumers demand greater capacity in magazines such as pistol magazines in the same amount of space as a traditional magazine. This presents several engineering challenges, especially when working with rimmed cartridges. The imaginary projected three-dimensional outer envelope drawn between the radially extending rim at the base of the cartridge case at one end and the opposite projectile end of the cartridge represents a cone in shape and determines the number and how such cartridges might be stacked in the magazine. Such rimmed cartridges may include for example without limitation a. 22 LR rimfire cartridge, 22 Winchester Magnum Rimfire (WMR) cartridge, .303 British centerfire cartridge, 30-30 Winchester centerfire cartridge, 7.62×54R centerfire cartridge, etc. Accordingly, rimmed cartridges typically don't achieve the same packing density as rimless cartridges in the magazine due to the outwardly projecting rims.

By contrast, traditional non-rimmed (rimless) pistol cartridge used for many centerfire firearms define a cylindrical shaped projected outer envelope due to the lack of outwardly protruding rims at the base of the cartridge case (such as for example a 9 mm Parabellum cartridge, .380 ACP cartridge, etc.). Therefore, this permits tight nesting of such cartridges and favorable packing density in the magazine.

As additional background, rimfire cartridges such as the .22 LR comprise a crushable annular rim at the base of the cartridge case which contains the primer compound used to ignite the powder charge in the cartridge. The rim is struck by the firing pin of the firearm actuated via a trigger pull to ignite the charge. By contrast, centerfire cartridges such as the 9 mm Parabellum round comprise a percussion cap centered on the base of the cartridge case which is struck by the firing pin to ignite the charge. A rimmed cartridge broadly refers to a cartridge having a radially protruding rim at the base of the cartridge case which forms a flange with a diameter greater than the diameter of the adjoining cartridge case at the base of the cartridge.

Magazines designed for rimmed cartridges with conical projected outer envelopes are typically elongated and curved when used with a shouldered long gun, such as that of the Soviet SVT, Romanian PSL and British Enfield (which was a short magazine that had a large angled baseplate to accommodate the rims). Such magazines typically have a length that extends a significant amount below the magazine well of the firearm and are exposed for a majority of their length. In a pistol applications, however, magazines are not traditionally curved and may be somewhat shorter in length. Such magazines are housed at least partially inside the hand grip which defines the magazine well. Therefore, getting rimmed cartridges to stack on top of one another vertically in steel bodies of box-type magazine and feeding reliably into the breech area of the firearm at the desired dispensing angle without cartridge jams is an engineering challenge.

Additionally, the rims present other design challenges such as rimlock—where the cartridge in the feeding position is prevented from sliding out of the magazine by the next cartridge's rim from improper loading.

Improvements in the packing density of magazines suitable for holding and reliably dispensing rimmed ammunition cartridges without jams are desired.

SUMMARY

The present disclosure provides an ammunition magazine with improved packing density, detachably mountable to a firearm which overcomes the foregoing design and operational obstacles for storing and reliably dispensing rimmed cartridges. The rimmed cartridges may be centerfire or rimfire cartridges. In one non-limiting embodiment, for example, the cartridges may be may be .22 LR rimfire cartridges; however, other types and calibers of rimmed cartridges described heretofore may be used.

In one non-limiting embodiment, the present magazine is specially designed and operable to store and dispense rimmed cartridges from a metal-bodied, vertically staggered double stack of cartridges thereby improving packing density and enabling the magazine to hold more than twelve rounds of ammunition, and in one embodiment twenty rounds of. 22 LR ammunition. Advantageously, the magazine is configured so that the overall length of magazine is similar to that of standard rimfire pistol magazines such as for example without limitation a Ruger 22/45 or Ruger MKIV pistol magazine, but provides greater cartridge storage capacity.

The magazine includes a cartridge feed mechanism comprising a spring-biased follower which supports and dispenses the stack of rimmed cartridges from the magazine. The follower includes angled front and rear cartridge feed surfaces each configured to exclusively engage and support the cartridge stack at alternate times depending on the number of cartridges present in the magazine. The cartridge feed surfaces are configured to ensure that the proper presentation angle of the uppermost cartridge to the firearm is provided to in turn ensure reliable feeding and chambering of the round of ammunition each time the firearm is discharged.

Because rimmed cartridges are arranged in a vertically staggered double stack in the magazine, the cartridges are oriented at a skewed angle to a vertical reference plane extending in the front to rear direction of the magazine which is aligned with the longitudinal axis of the firearm when the magazine is mounted therein. Accordingly, the magazine further includes a pair of non-linear cartridge convergence ribs configured to engage the cartridge stack and force the front projectile ends of the cartridges together as they advance upwards in the magazine towards the top for dispensing. The non-linear convergence ribs operate to center an uppermost cartridge in the stack to ensure reliable dispensing from the magazine to the firearm for chambering. As further explained herein, conventional linear cartridge guide ribs used in some rimless cartridge magazines do not function properly with rimmed cartridges thereby increasing the likelihood of magazine feeding jams in some cases. The present non-linear cartridge convergence ribs overcomes those problems.

Although the magazine may be described herein and configured for use in a semiautomatic pistol for convenience of description which is chambered to fire rimmed cartridges (as one non-limiting application example), the magazine is not so limited in its applicability. Accordingly, the present magazine can also be used in semi-automatic or manually-operated bolt action long guns (e.g., rifles or carbines) chambered for firing rimmed cartridges. Accordingly, the invention is expressly not limited to use in handguns alone.

In one aspect, a double stack magazine for a firearm comprises: an elongated tubular magazine body defining a vertical centerline and an internal cavity configured to hold a stack of rimmed cartridges, the magazine body including an at least partially open top end, a bottom end, a front wall, a rear wall, and opposed lateral sidewalls extending between the front and rear walls; the magazine body including a lower double stack section configured to hold a vertically staggered double stack of the cartridges, an upper single stack section, and a transition section formed between the double stack section and the single stack section; a spring disposed in the cavity; a follower moveably disposed in the cavity and biased in an upwards direction towards the top end of the magazine body by the spring; the follower comprising a rear cartridge feed surface and adjoining front cartridge feed surface each configured to selectively engage and support an ammunition cartridge, the rear feed ramp being disposed at an oblique angle to the front feed ramp; the front and rear cartridge feed surfaces each configured to engage and support a lowermost cartridge of the stack at alternate different times depending on a number of cartridges present in the stack. In one embodiment, the front cartridge feed surface is sloped at a first angle from 0 degrees to about and including 20 degrees with respect to a horizontal reference plane oriented perpendicularly to the vertical centerline of the magazine, and the rear cartridge feed surface sloped in an upwards direction from rear to front at a second angle with respect to the horizontal reference plane which is greater than the first angle.

According to another aspect, a firearm with a double stack ammunition magazine comprises: a longitudinal axis; a frame defining a magazine well; a magazine removably mounted in the magazine well, the magazine comprising: a tubular magazine body defining a vertical centerline and an internal cavity configured to hold a stack of cartridges having a radially protruding rim; the magazine body including a partially open top end, a bottom end, a lower double stack section, an upper single stack section, and a transition section formed between the double stack section and the single stack section; the cartridges in the lower double stack section being vertically staggered and oriented at a skewed angle to a vertical reference plane; a follower moveably disposed in the internal cavity and biased in an upwards direction towards the top end of the magazine body by a spring, the follower supporting the stack of cartridges and operable to dispense to the cartridges from the magazine; and a laterally spaced apart pair of arcuately curved non-linear cartridge convergence ribs disposed in a front half of the magazine in the upper single stack section; wherein the non-linear cartridge convergence ribs are operable to squeeze a front portion of the cartridges in the upper single stack section together so that an uppermost cartridge in the stack becomes aligned in-plane with the vertical reference plane for dispensing into a breech area of the firearm.

According to another aspect, a method for operating a double stack ammunition magazine for a firearm comprises: providing the magazine which includes a partially open top end, a bottom end, a lower double stack section, an upper single stack section, a transition section formed between the double stack section and the single stack section, an internal cavity, and an upwardly spring-biased follower movably disposed in the internal cavity; loading a stack of cartridges into the internal cavity of the magazine until the stack of cartridges extends from the upper single stack section down into the lower double stack section of the magazine; depressing the follower downwards in the internal cavity via engagement by a lowermost cartridge in the stack of cartridges with an angled front cartridge feed surface of the follower during the loading step; dispensing cartridges from the magazine until no cartridges in the stack of cartridges are present in the lower double stack section; and rotating the lowermost cartridge in the stack of cartridges to disengage the front cartridge feed surface and engage an angled rear cartridge feed surface of the follower; wherein the rear cartridge feed surface is disposed at a first angle to a horizontal reference plane of the magazine and the front cartridge feed surface is disposed at a second angle to the horizontal reference plane, the first angle being larger than the second angle. In one embodiment, the dispensing step includes slideably engaging a front portion of the cartridges in the upper single stack section when cartridges are dispensed with a pair of laterally spaced apart non-linear cartridge convergence ribs. The non-linear cartridge convergence ribs are configured to squeeze the front portions of the cartridge together to rotate an uppermost cartridge in the stack in-plane with a vertical reference plane of the magazine for dispensing into a breech area of the firearm.

BRIEF DESCRIPTION OF THE DRAWINGS

The features of the exemplary embodiments will be described with reference to the following drawings where like elements are labeled similarly, and in which.

Figure 1:
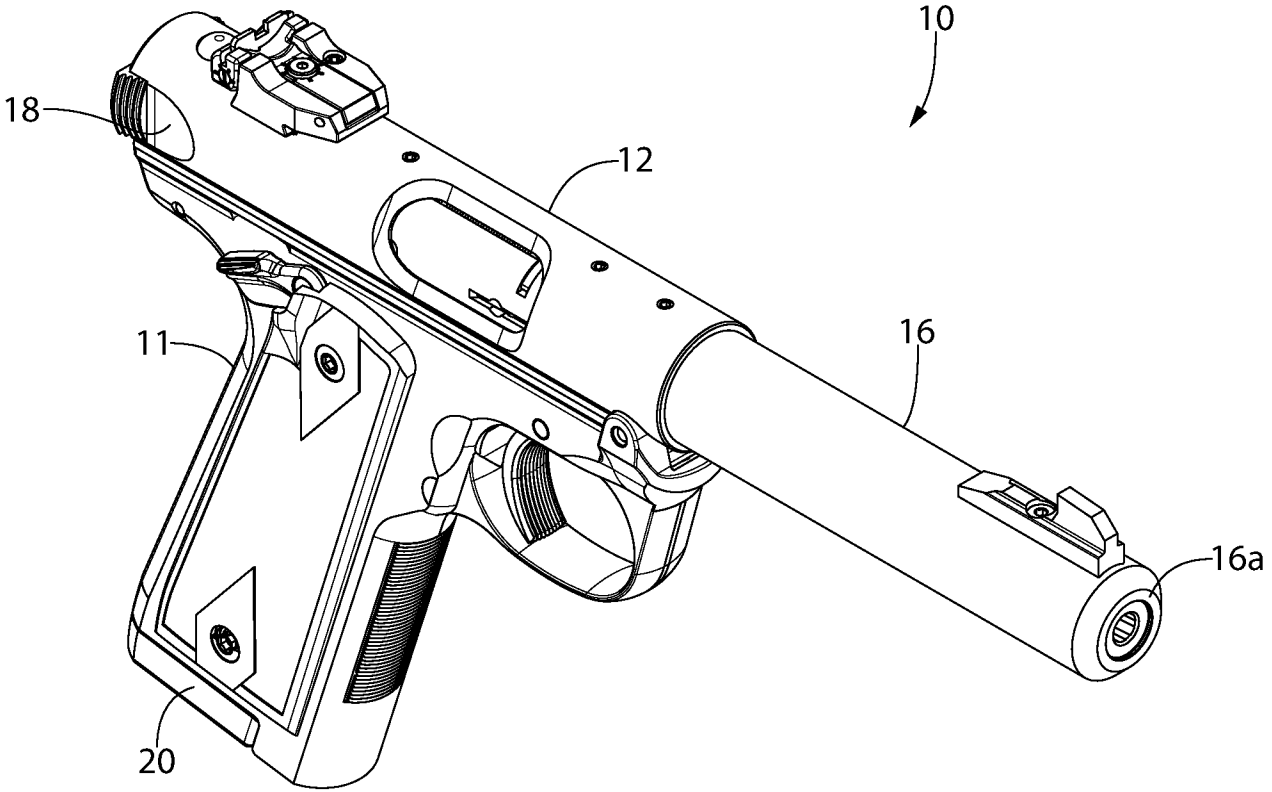
FIG. 1 is a top perspective view of a firearm comprising a high-capacity magazine according to the present disclosure.
Figure 2:
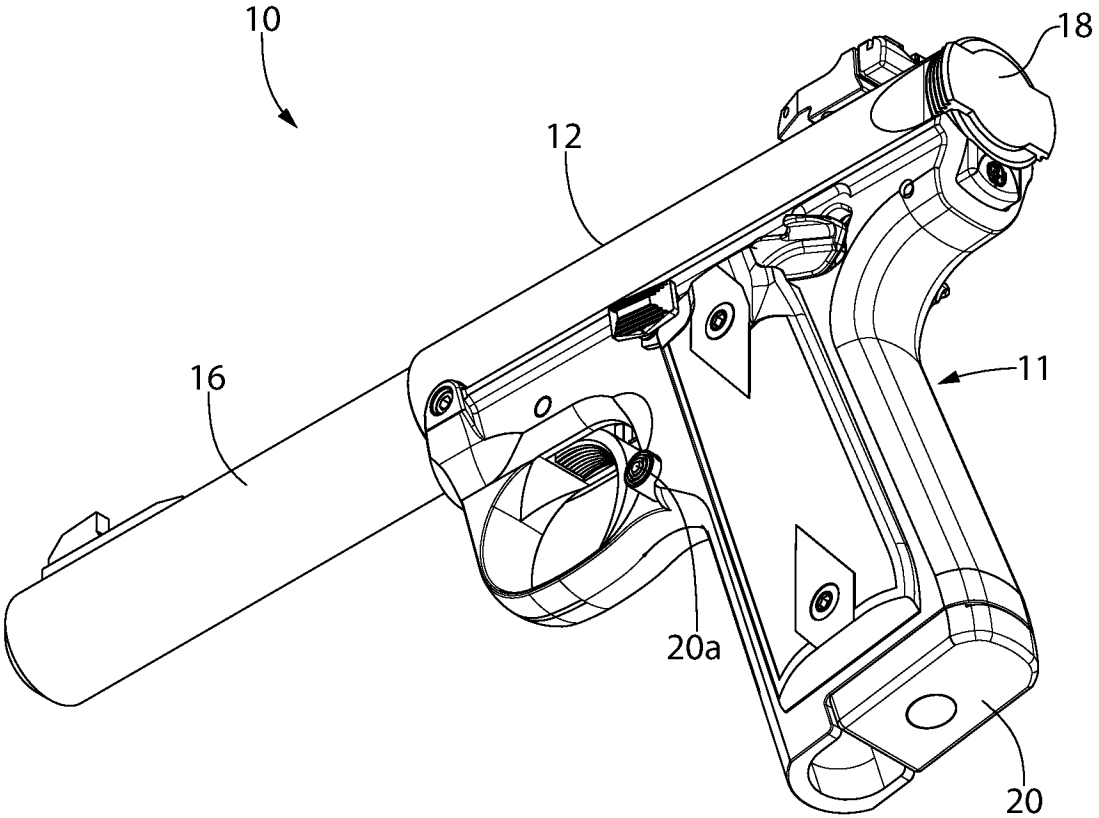
FIG. 2 is a bottom perspective view thereof.
Figure 3:
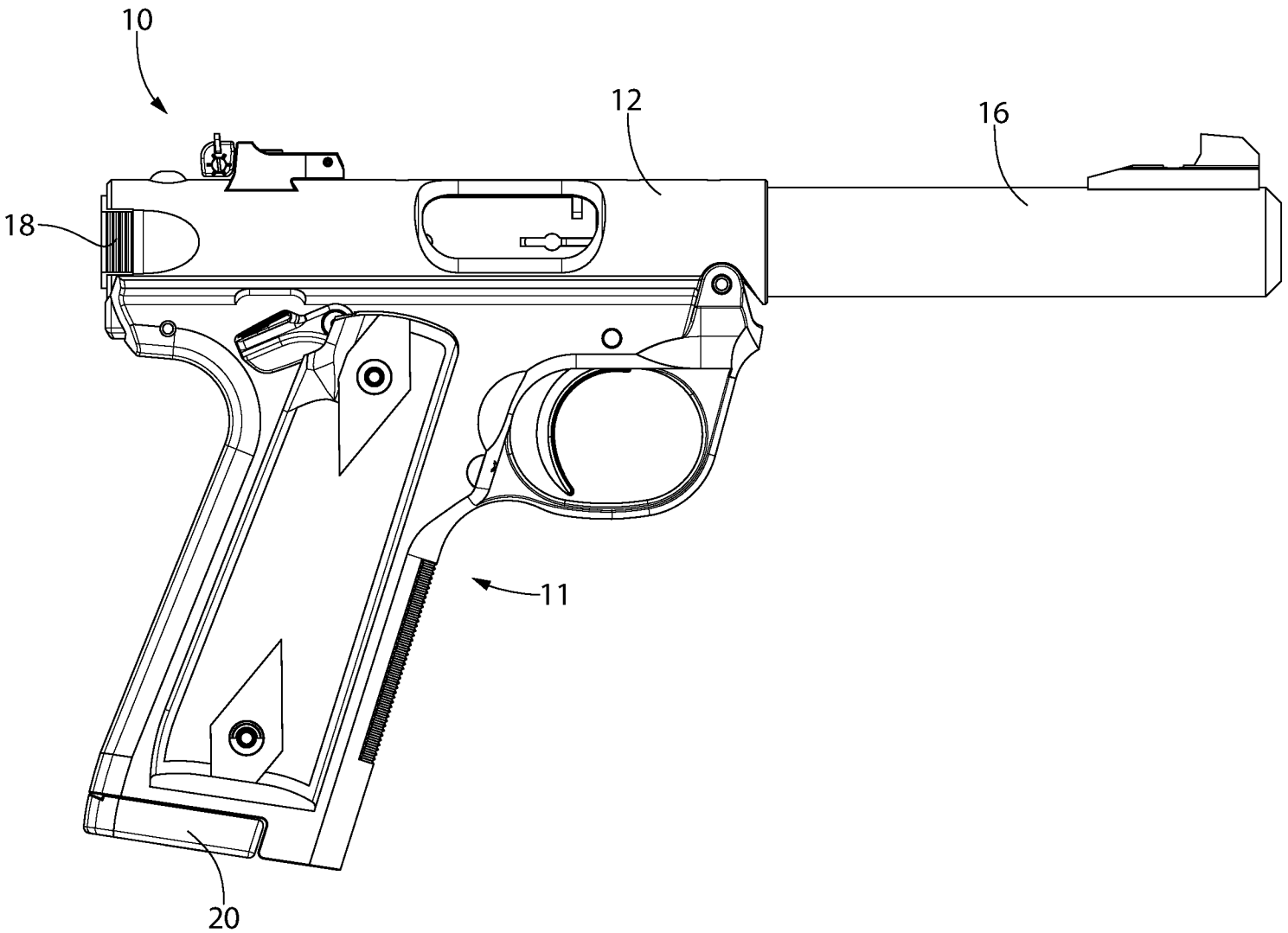
FIG. 3 is a right side view thereof.

All drawings are schematic and not necessarily to scale. Parts given a reference numerical designation in one figure may be considered to be the same parts where they appear in other figures without a numerical designation for brevity unless specifically labeled with a different part number and/or described herein. A reference herein to a figure number in which several figures share the same number but are differentiated by different alphabetical suffixed shall be construed as a general reference to all of those figures unless explicitly noted otherwise.

DETAILED DESCRIPTION

The features and benefits of the invention are illustrated and described herein by reference to exemplary ("example") embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

The terms "shell" and "cartridge" may be used interchangeably herein in reference to describing ammunition, and therefore should not be construed as limiting the invention or the claims appended hereto. For convenience and brevity, further description of ammunition which follows will generally use the non-limiting term of "cartridge."

As used throughout, any ranges disclosed herein are used as shorthand for describing each and every value that is within the range. Any value within the range can be selected as the terminus of the range. In addition, any references which may be cited herein are all hereby incorporated by reference in their entireties. In the event of a conflict in a definition or meaning of a term in the present disclosure and that of a cited reference, the present disclosure controls.

A detachable box-type firearm magazine for use with rimmed cartridges according to the present disclosure may be used in autoloading firearms such as without limitation a semi-automatic pistol which is shown and described to illustrate one non-limiting example, or long guns such as rifles, or other types of autoloading or manual loading firearms. The type of autoloading or manual loading firearm does not limit the scope or applicability of the invention.

For convenience of description and not limitation, the non-limiting illustrated embodiment disclosed depicts the present magazine used with a stack of .22 LR rimfire rimmed cartridges. However, the magazine may be used with rimmed centerfire cartridges in other embodiments (e.g., .357 magnum .38 special cartridge, .45 Colt, etc.). Accordingly, the present invention is not necessarily limited to use with rimfire cartridges alone in which the primer is located in the crushable rim of the cartridge.

The term "rimmed" cartridge is used in its conventional sense in the art to connote a cartridge having a radially protruding rim at bottom that forms a flange with a diameter greater than the diameter of the cartridge case at the base of the cartridge. 'Semi-rimmed' cartridges are considered functionally identical to 'rimmed' cartridges as the former have a rim that is greater in diameter than the case at the rim, but to a lesser degree than 'rimmed' cartridges.

FIGS. 1-4B depict a firearm 10 which includes a detachable box style magazine 20 and features thereof according to the present disclosure. Firearm 10 in one non-limiting embodiment as illustrated may be in the form of semi-automatic pistol for convenience in describing the present invention. However, firearm 10 may be other types of firearms usable with magazine 20 such as a long gun (e.g., rifle or carbine).

Firearm 10 includes longitudinal axis LA, a chassis or frame 11 supporting a barrel-receiver assembly comprising a receiver 12 supported by the frame, barrel 16 coupled to the receiver, and a trigger-operated firing mechanism 14 configured and operable to discharge the firearm. In the embodiment shown, firearm 10 may comprise a reciprocating bolt 18 slideably disposed in receiver 12 which cycles rearward to an open breech position when the firearm is fired, and is returned forward to a closed breech position by recoil spring 18*a*. In another embodiment, the firearm may include a reciprocating slide which reciprocates rearward and forward on the frame between the open and closed breech positions. The slide defines a front breech face which forms a closed breech in lieu of the bolt. These embodiments apply to rifles as well. Both types of semi-automatic pistol formed may be used with the present magazine 20 and are well known to those skilled in the art without further unnecessary elaboration here. The inventive magazine 20 is therefore not limited in its application.

Figure 4A:
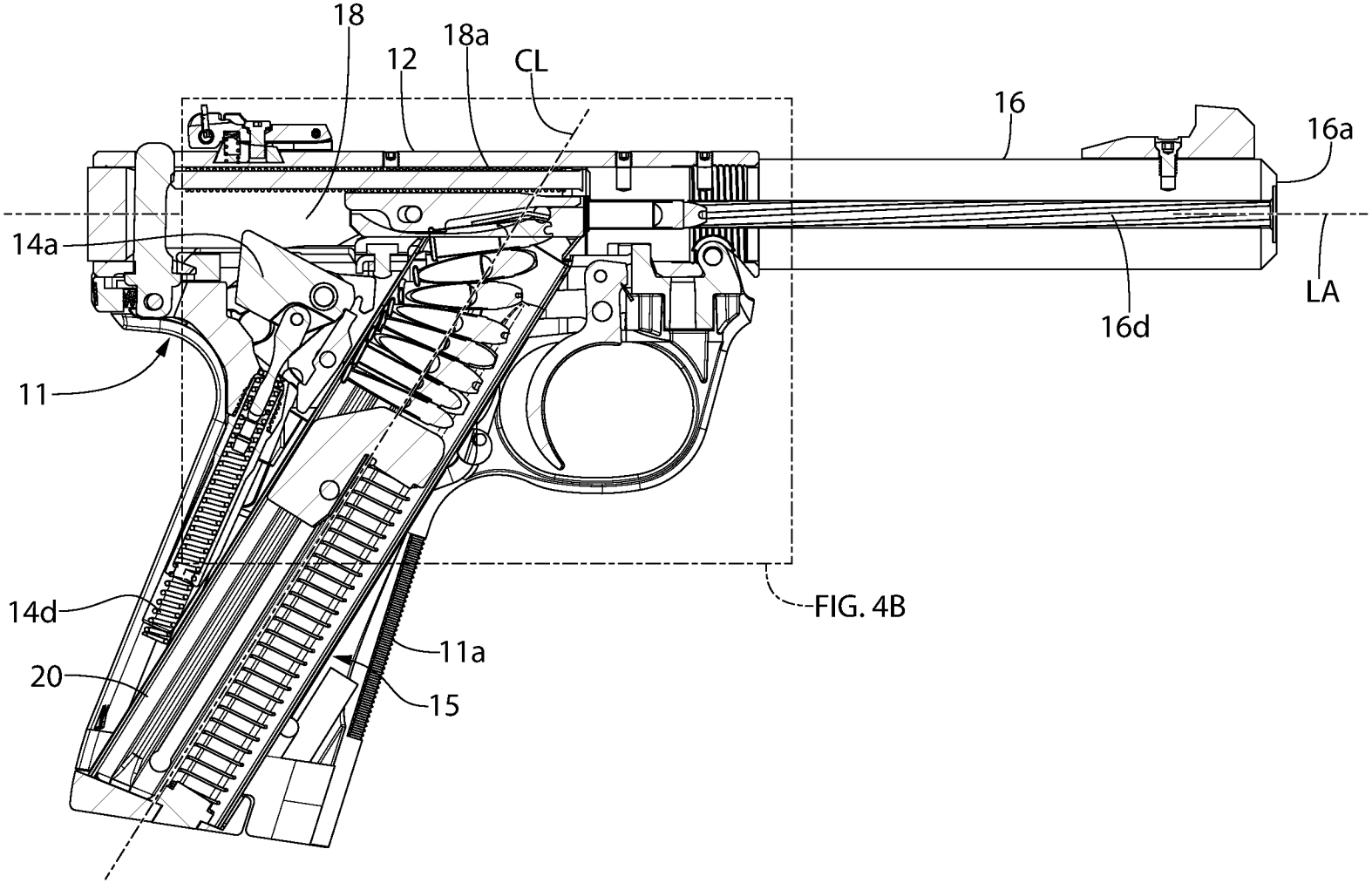
FIG. 4A is a cross-sectional view thereof.
Figure 4B:
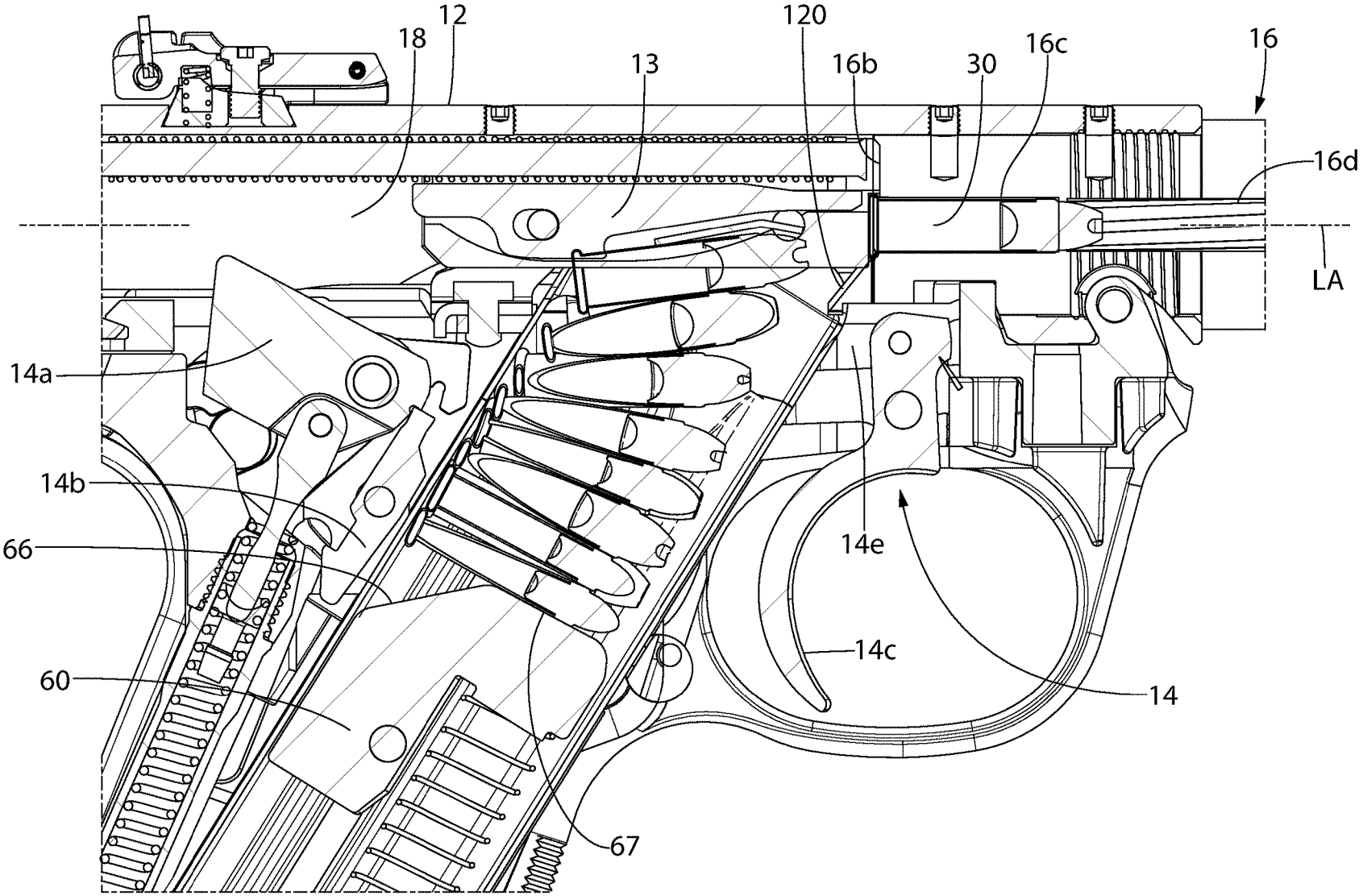
FIG. 4B is an enlarged detail taken from FIG. 4A.
Figure 5:
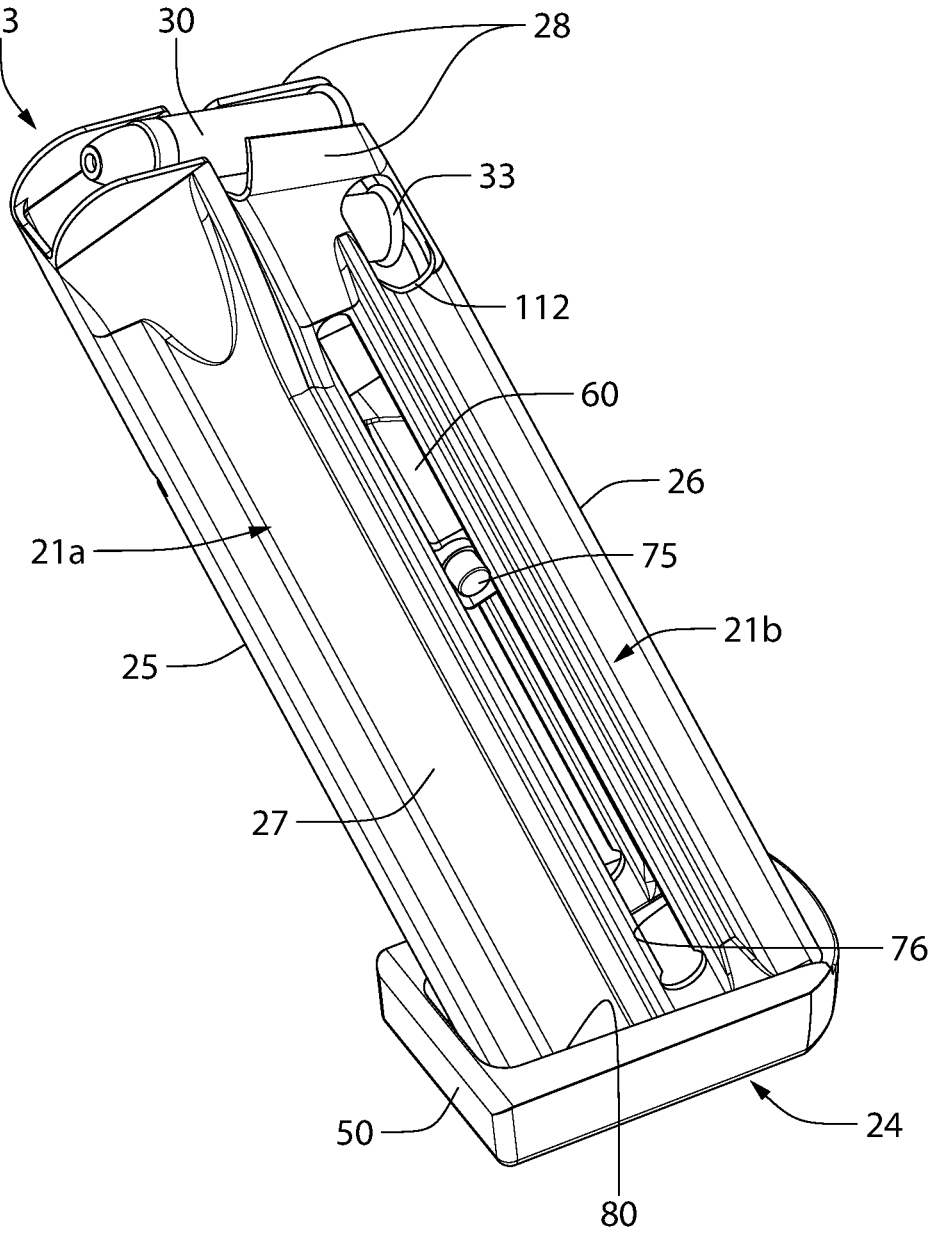
FIG. 5 is top left perspective view of the magazine.
Figure 6:
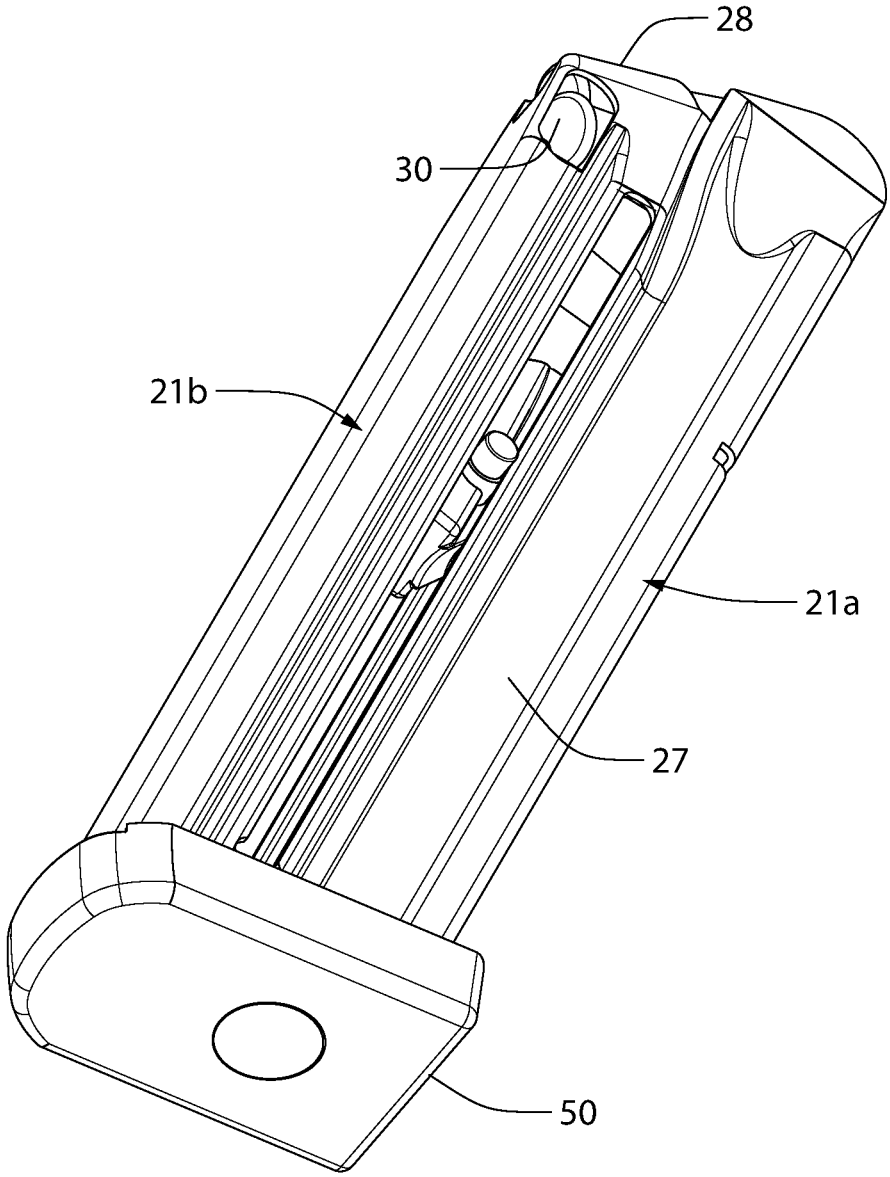
FIG. 6 is a bottom right perspective view thereof.
Figure 7:
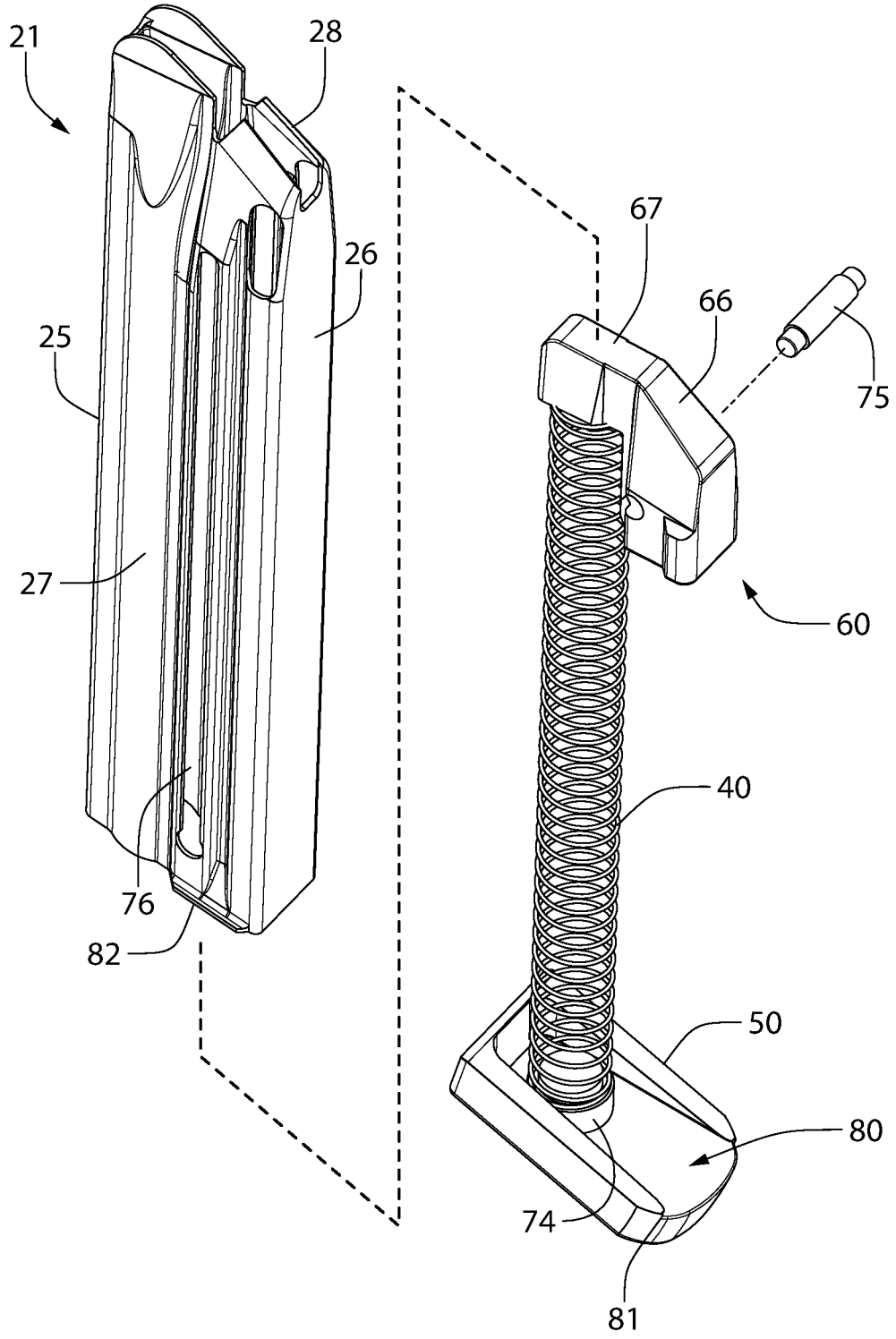
FIG. 7 is an exploded perspective view thereof.
Figure 8:
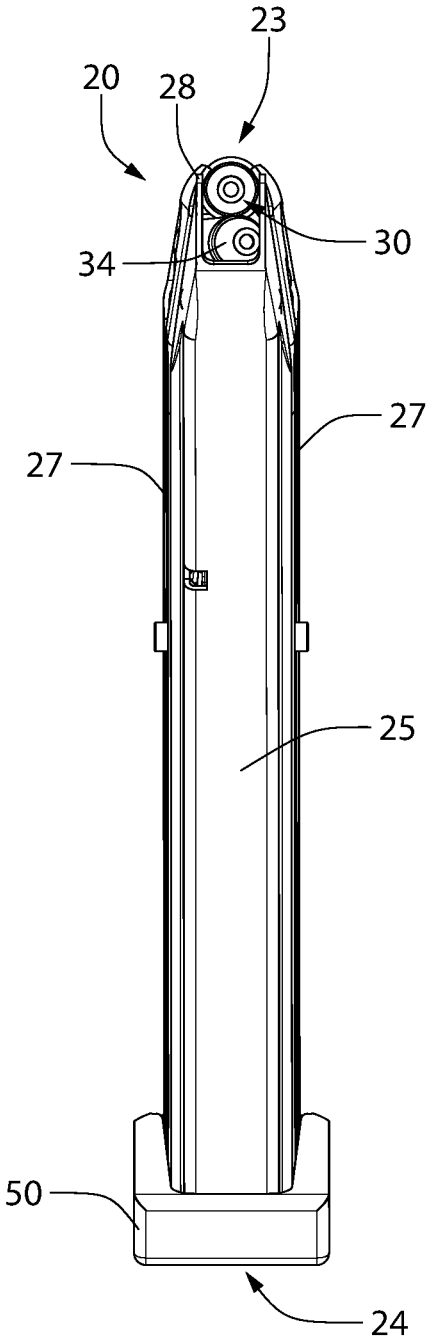
FIG. 8 is a front view thereof.
Figure 9:
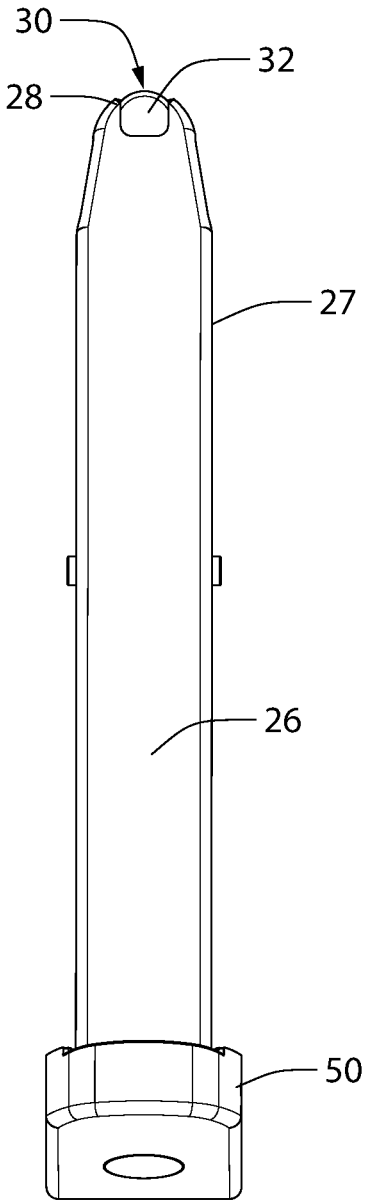
FIG. 9 is a rear view thereof.
Figure 10:
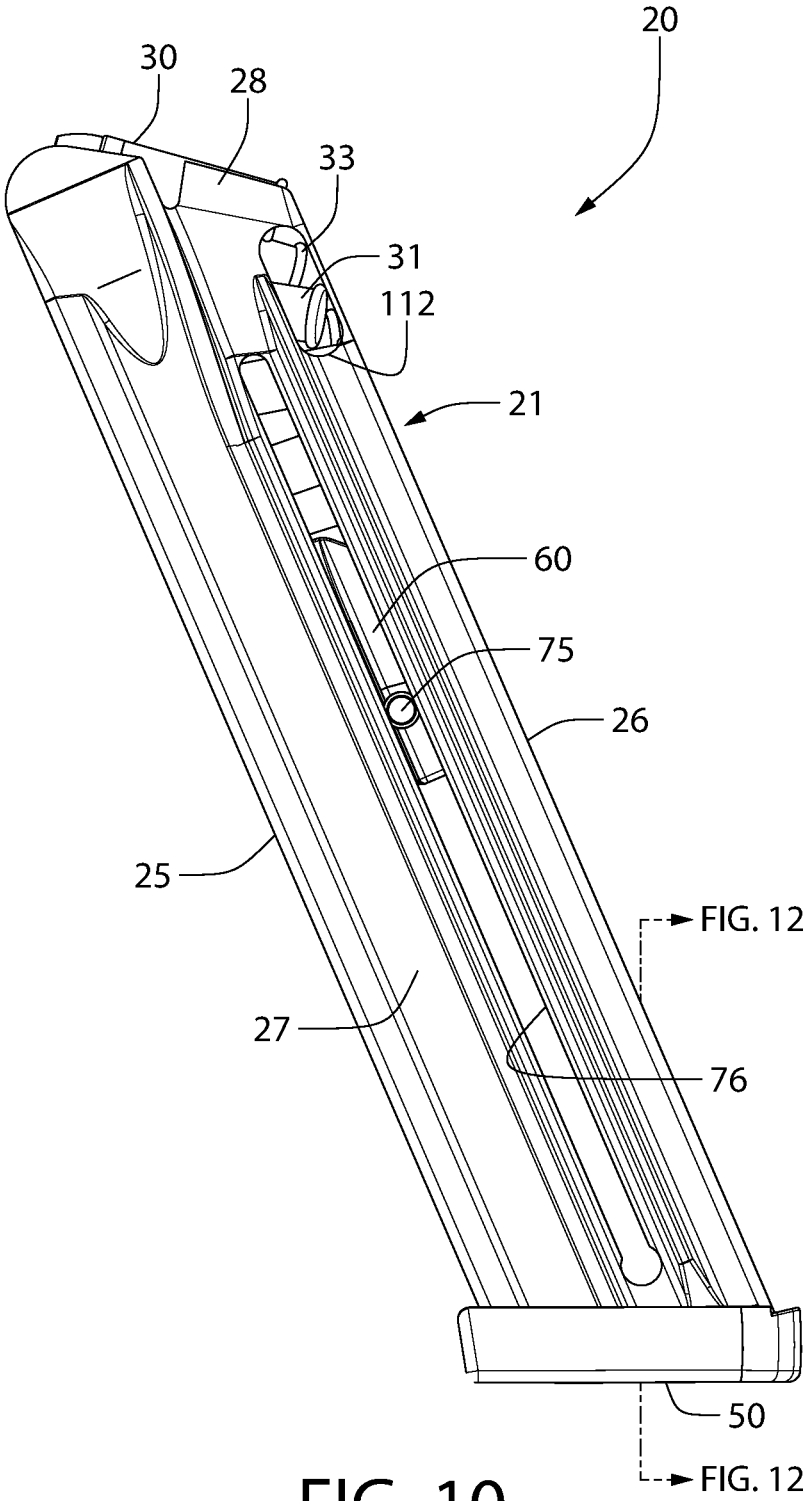
FIG. 10 is a left side view thereof.
Figure 11:
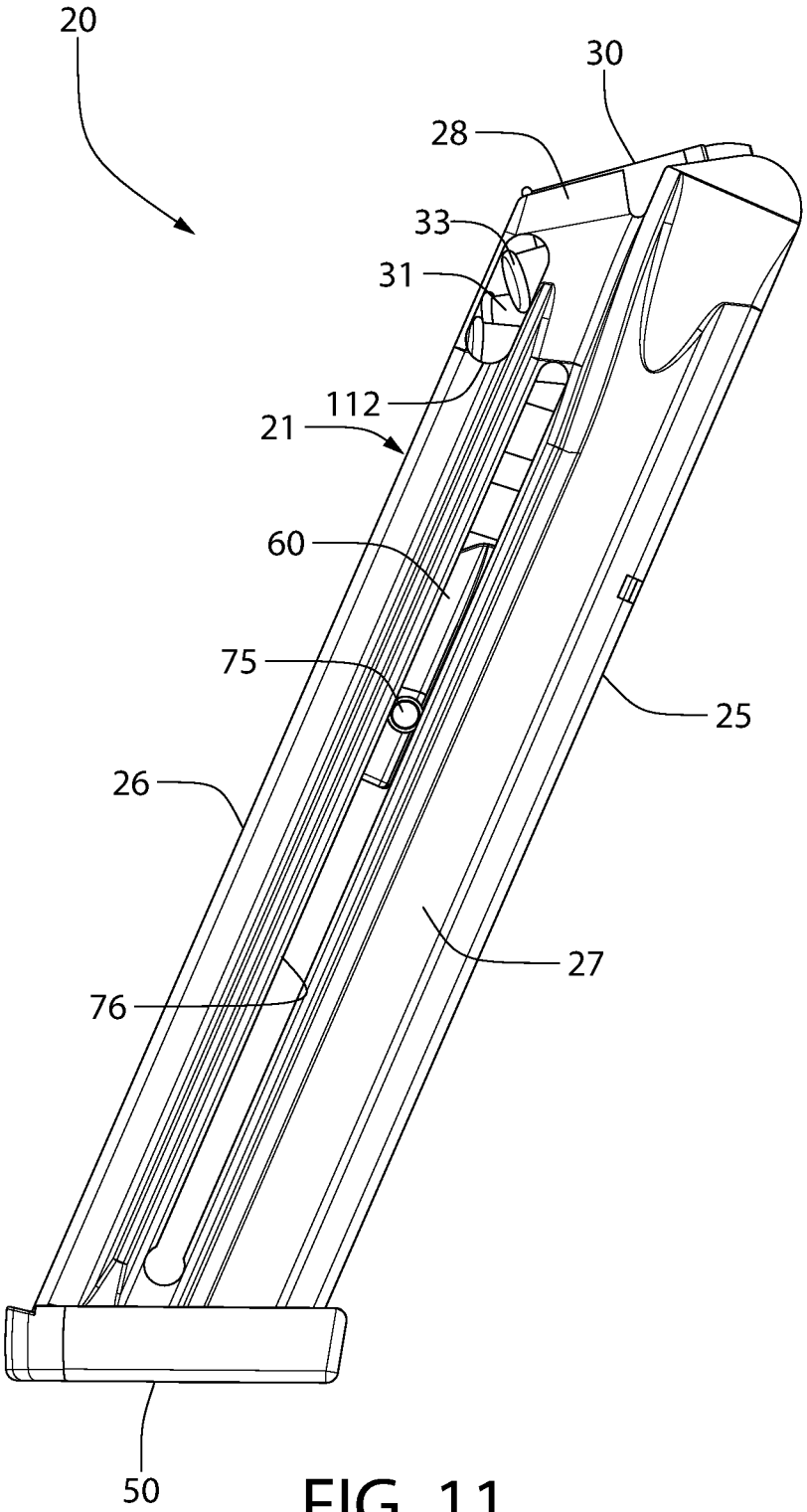
FIG. 11 is a right side view thereof.

Barrel 16 includes front muzzle end 16*a*, rear breech end 16*b*, and an enlarged cartridge-receiving chamber 16*c* adjacent the breech end which is configured to hold a cartridge 30 (see, e.g., FIGS. 4A and 4B). Longitudinally-extending axial bore 16*d* formed between the muzzle and breech ends in barrel 16 is in communication with chamber 16*c* and defines a projectile (e.g., bullet or slug) passageway. The axial centerline of barrel bore 16*d* defines longitudinal axis LA of the firearm 10.

Pistol 20 may be hammer-fired in one embodiment. Firing mechanism 14 is configured and operable to automatically cycle the action to discharge a chambered cartridge 30, extract and eject the spent or empty cartridge casing from the chamber and firearm, and load or chamber a fresh cartridge automatically dispensed by magazine 20. This system can also manually extract and eject an unfired round and feed the next round from the magazine. The firing mechanism may be supported by frame 11 as shown, or alternatively be disposed in a separate detachably mountable fire control insert which can be installed in the frame (not shown).

Firing mechanism 14 may include a trigger 14*c* which is operably coupled to and cooperates with a rotatable sear 14*b* by a mechanical linkage 14*c*. The sear in turn is operably interfaced and cooperates with the spring biased pivotably movable hammer 14*a* acted upon by hammer spring 14*d* carried by frame 11, as shown. The hammer 14*a* cooperates with and strikes the rear end of a spring-biased firing pin 13 disposed in bolt 18. Firing pin 13 is movable in an axial forward direction to strike a chambered cartridge 30 and discharge the firearm via a trigger pull which releases the hammer. Hammer 14*a* is movable between a rearward cocked position engaged by sear 14*b*, and forward firing position to strike the cartridge when disengaged from the sear. In the non-limiting illustrated embodiment, the forward portion of firing pin 13 is slightly offset from longitudinal axis LA of the firearm to strike and crush the rim of the cartridge in the case of a rimfire cartridge. If a centerfire cartridge were used with a percussion cap centered on its base, the forward portion of the firing pin would be coaxially aligned with the longitudinal axis LA to strike the percussion cap which contains the primer.

Pistol 20 may function in the conventional manner well known in the art to discharge the firearm. In operation, with a rearward cocked hammer 14*a* held in position by scar 14*b*, pulling the trigger 14*c* of trigger mechanism 14 rearwards rotates sear 14*b* which in turn disengages and releases the hammer 14*a* forward to strike the firing pin 13. The firing pin is in turn driven forward to strike the chambered cartridge 30 and discharge the firearm.

In other possible embodiments, the pistol may be striker-fired comprising a spring biased linear acting striker in lieu of the hammer and firing pin to strike the chambered cartridge and discharge the firearm. The striker combines the firing pin and hammer functions, as is well known to those skilled in the art. Accordingly, the magazine 20 is expressly not limited in use or applicability to either hammer-fired or striker-fired firearms.

In addition to FIGS. 1-4B, reference is now also made FIGS. 5-28 which specifically show the magazine 20 and various features thereof removed from the firearm. The magazine will now be further described.

Magazine 20 may be a box-type magazine configured for holding ammunition cartridges, such as without limitation rimmed cartridges in one embodiment. In one non-limiting embodiment, as an example, the cartridges may be .22 LR rimmed rimfire cartridges; however, other rimmed cartridges and rimless cartridges may be used in other embodiments of the magazine.

Magazine 20 generally comprises a hollow and elongated open tubular magazine body 21 (also referred to as a magazine tube in the art) that defines an internal cavity 22 configured for holding a plurality of cartridges 30. Cavity 22 extends for the full interior height of the magazine body. In some embodiments, magazine 21 is configured to have a capacity for holding and dispensing greater than 10 ammunition cartridges, which is a common maximum capacity of standard magazines for pistols. In one representative non-limiting embodiment, magazine 21 may have a 20 cartridge capacity for holding .22LR rimmed cartridges. In order to package more than 10 cartridges into the magazine while retaining the same general length as a standard magazine, the tubular body of the magazine 20 includes a lower double stack section 100 configured to hold a vertically staggered double stack of the rimmed cartridges 30 therein, and an upper single stack section 101 configured to gradually converge the double cartridge stack together so as to form a generally single stack of cartridges therein configured to dispense a single cartridge at a time in a single position into the breech area of the firearm each time the action is cycled. The term "vertically staggered" connotes that the centerline Cc of each cartridge (extending through the projectile and the base thereof shown in FIG. 22) in the stack is laterally offset from the centerline of the adjacent cartridges and centerline CL of the magazine (see, e.g., FIG. 21).

The upper portions of the sidewalls 27 in single stack section 101 are angled with respect to each other (i.e. non-parallel) and inclined inwards towards vertical reference plane VP and centerline CL of the magazine. Transition section 102 is formed between lower double stack section 100 and upper single stack section 101 at the point where the sidewalls begin to angle inwards into cavity 22 of the magazine. Lower double stack section 100 has a larger lateral width than the top end 23 of magazine 20. Upper single stack section 101 may have a generally frustoconical shape when viewed from front to rear, or vice-versa (see, e.g., FIG. 21).

Cartridges 30 in the lower double stack section 100 as shown are positioned in vertically offset or staggered side to side relationship at an acute angle A4 to the next higher or lower adjacent cartridge in the stack with respect to a horizontal reference plane HP extending through and intersecting the lower double stack section of the magazine. This vertically staggered relationship is attributable to the radially protruding rims 33 of the rimmed cartridges 30. There are no two cartridges in direct side to side relationship in which the centers of the cartridges lie in the same horizontal plane in the lower double stack section 100 (see, e.g., FIGS. 15 and 21). Angle A4 is determined and selected to prevent "friction lock" of the cartridges against the sidewalls of the magazine, but still maximize cartridge packing density in the lower double stack section.

The lateral sidewalls 27 of tubular magazine body 21 in lower double stack section 100 may be parallel relative to each other. Sidewalls 27 in upper single stack section 101 however are sloped inwards relative to each other and converge moving upwards towards the open top end 23 of the magazine having a width configured to dispense just a single cartridge one at a time into the breech area of firearm 10 via the spring-biased cartridge feed mechanism further described elsewhere herein. The point at which the top of the parallel sidewalls 27 of the lower double stack section begin to converge and angle towards each other defines a transition section 102 in the magazine body between the lower double stack section and the upper single stack section (see, e.g., FIGS. 15 and 21).

The tubular magazine body 21 of the magazine 20 is elongated in both the vertical direction (top to bottom) and the horizontal direction (front to rear). The body 21 defines a vertical centerline CL lying in vertical reference plane VP and extending from and through the top and bottom of the magazine through the geometric center of the magazine (see, e.g., FIGS. 13, 15, and 21. As shown in FIG. 4A, when magazine 20 is mounted in magazine well of firearm 10, the magazine centerline CL extends transversely but not necessarily perpendicularly to longitudinal axis LA of the firearm. As shown, the centerline CL may be obliquely oriented to longitudinal axis LA defined by the barrel 16 since the magazine may have an angular position coinciding with the slightly angled orientation of the rear grip portion 11*a* of the frame 11 for firearm gripping ergonomics. Magazine 20 defines vertical reference plane VP extending front to rear which contains vertical centerline CL (see, e.g., FIGS. 15 and 21), and the longitudinal axis LA of firearm 10 when the magazine is mounted therein.

The tubular magazine body 21 comprises a partially open top end 23, open bottom end 24, front wall 25, rear wall 26, and pair of opposing laterally spaced apart sidewalls 27 extending therebetween along the longitudinal axis LA. The walls 25-27 extend vertically in the direction of centerline CL of magazine 20. Centerline CL passes through the geometric center of the magazine body defined in a horizontal reference plane HP between the front and rear walls in one direction and laterally between sidewalls 27 in the other direction.

The magazine tube or body 21 may be formed of a suitable preferably lightweight material such as without limitation a metal (e.g. steel or aluminum), plastics (e.g. polycarbonates, nylon) or composites (e.g. reinforced nylon). Other materials may be used.

The top end 23 of the magazine is substantially open and includes a pair of inwardly extending (e.g., angled or curved) cartridge feed lips 28 which engage and retain the uppermost cartridge 30 in the stack. This prevents the column or stack of cartridge from being vertically ejected from the top of the magazine by the cartridge spring feed mechanism further described herein. The feed lips also position the top cartridge at the desired presentation angle for proper feeding into the breech and chamber, and provide a passage therebetween for the bolt or slide to enter and strip the uppermost round out of the magazine. In one embodiment, the feed lips 28 may be configured and positioned to engage the generally straight portion of cartridge case between the projectile (e.g., bullet or slug) at front and rear base of the cartridge 30. Accordingly, the cartridge feed lips 28 may be longitudinally offset towards and located in the rear half 21*b* of the magazine 20 such that the lips do not extend into the front half 21*a* of the magazine which holds the projectile end of the stack of cartridges 30.

Figure 20:
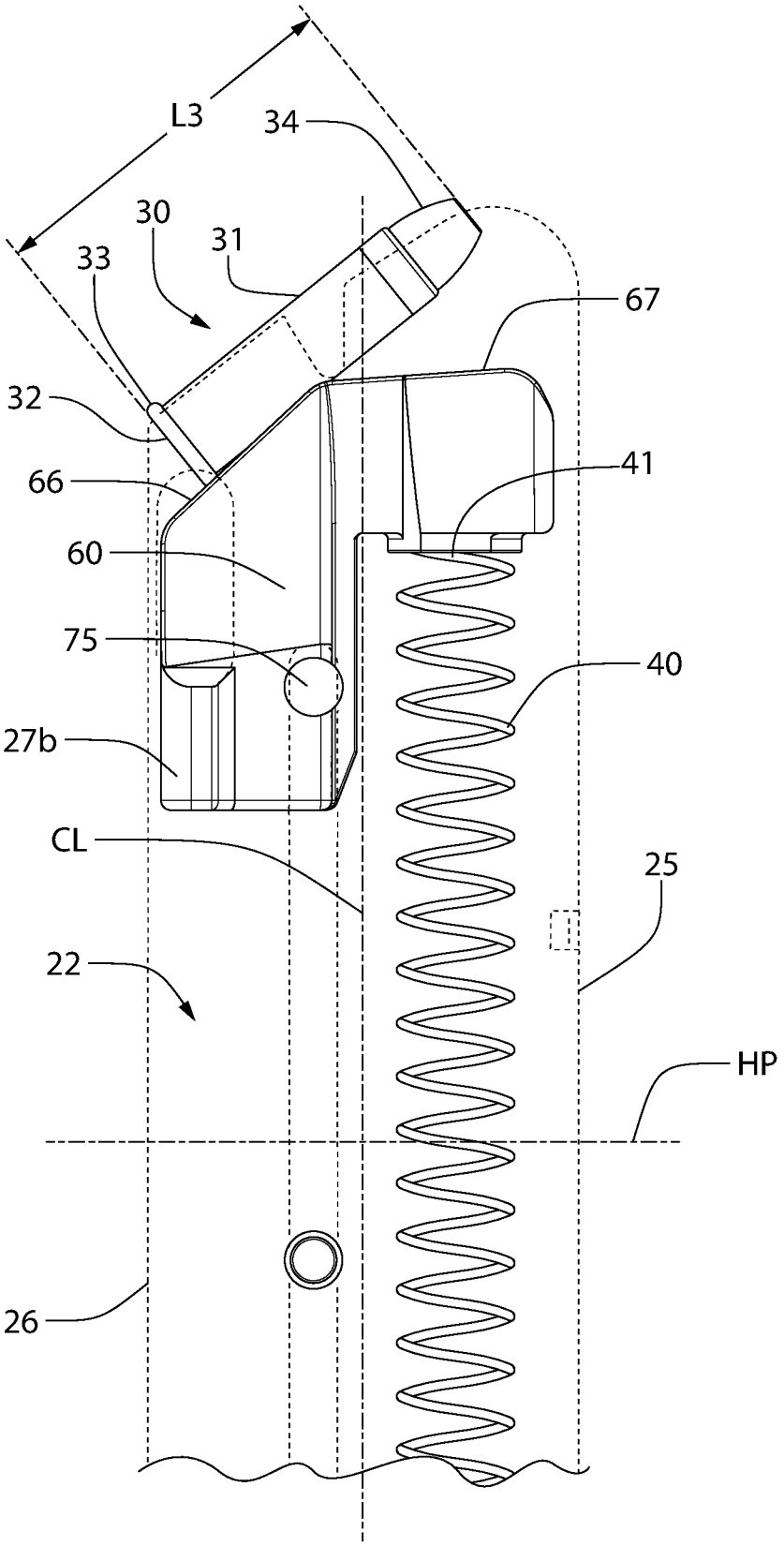
FIG. 20 is a side view of the cartridge feeding mechanism showing the spring-biased magazine follower supporting a cartridge from a first cartridge feed surface and the magazine body shown in dashed phantom lines.

Referring to FIG. 20, the rimmed cartridges 30 in one embodiment each include a cartridge base 32 ("case head") at one end, projectile 34 (e.g., bullet or slug) at the opposite end, and annular generally cylindrical cartridge case 31 extending between the ends. A radially protruding annular rim 33 is formed at the base end of case 31 having a diameter larger than the adjoining base end of the case. Cartridge 30 has an overall length L3 measured from the tip of the projectile to the base 32 as shown. The rimmed cartridge 30 may be a rimfire or a centerfire cartridge in various embodiments.

The feed lips 28 are spaced laterally apart and extend axially (i.e. in the general direction of longitudinal axis LA) from a point proximate the rear wall 26 and terminate at a point spaced apart rearward from the front wall 25 by a sufficient horizontal distance to allow the cartridges to be axially dispensed from or inserted into the magazine 20 beneath the feed lips from the front half 21*a* of the magazine. In one embodiment, the feed lips may not extend farther than midway between the front and rear walls 25, 26 of the magazine.

In one embodiment, the magazine 20 may be configured for detachable mounting and insertion into a downwardly and upwardly open magazine well 15 defined by the grip portion 11*a* of frame 11 from the underside (bottom) of the firearm (see, e.g. FIG. 4A). In one embodiment, the magazine may be locked into the firearm via a laterally-operated spring-biased magazine latch 20*a* positioned in the frame of the firearm adjacent the magazine well (see, e.g., FIG. 2). The latch mechanism 20*a* locks the magazine in position for use and releases/drops the magazine via operation of the release button of the mechanism for exchanging magazines 20. Such magazine latch mechanisms including other variations and their operation are well known in the art without undue elaboration. Examples of various types of latch mechanisms are shown in commonly-owned U.S. Pat. No. 9,194,637, which is incorporated herein by reference in its entirety.

With continuing general reference to FIGS. 5-28 as applicable, magazine 20 further includes an internal cartridge spring feed mechanism. The spring mechanism is disposed in the cavity 22 of the magazine. The feed mechanism may include an axially elongated follower 60, magazine spring 40, and spring base 80 which is secured to bottom end of the magazine tube or body 24 by detachable floor plate 50. The spring biases the follower and stack of cartridges supported thereon upwards towards the open top end 23 of the magazine. The top end 41 of spring 40 engages the underside or bottom surface of the follower 60 (see, e.g., FIG. 20). The bottom end 42 of the spring engages the spring base 80 (see, e.g., FIG. 16).

In one embodiment, the magazine spring 40 may be a cylindrical helical or coil compression spring with circular shaped coils as shown in the non-limiting illustrated embodiment. The coils each define a diameter, and spring 40 may be a straight coil spring as shown. In alternative embodiments, square or rectangular cross-sectional wire profiles may be used instead of circular. Spring 40 may be formed of suitable spring steel wire. In some embodiments, the spring 40 may be a constant force spring; however, variable force springs as shown may also be used.

Figure 16:
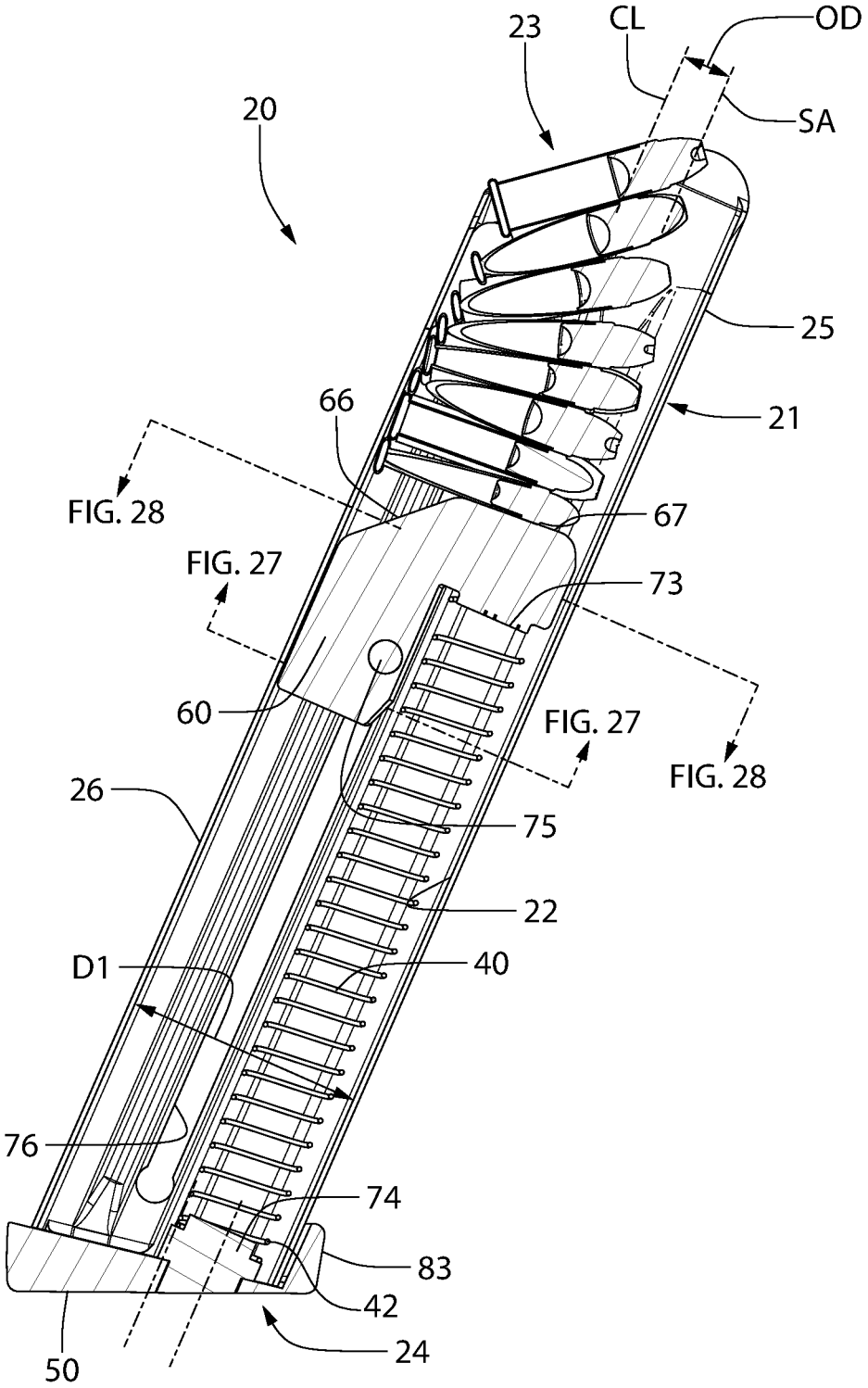
FIG. 16 is a right side vertical cross sectional view thereof.

Spring 40 extends vertically and defines a spring axis SA which may be axially spaced apart and offset from centerline CL of magazine 20 by an axial distance OD (see, e.g. FIG. 16). Spring 40 may be offset towards and located proximate to front wall 25 of the magazine body 21. Accordingly, the spring may be located directly beneath the open portion of the top end 23 of the magazine forward of the feed lips 28. This offset positioning of spring 40 allows the spring to actively bias the spring follower 60 upwards into a position with the spring force acting directly on the underside of the front portion of the follower. This advantageously contributes positive dispensing and feeding of the cartridges 30 from the magazine into the breech area of the firearm with the front tip or bullet of the cartridge angled upwards at the required angle for smooth chambering (sec also FIGS. 4A-B). An analogous arrangement is shown in commonly-owned U.S. Pat. No. 11,493,293, which is incorporated herein by reference in its entirety.

FIGS. 23-26 are various views which depict the follower 60 in isolation and greater detail. The follower 60 may have a generally inverted L-shaped magazine body in one non-limiting embodiment that is axially elongated in the direction of and aligned with the longitudinal axis LA of the firearm when mounted therein. In front to rear length, the follower extends axially from the front wall 25 to rear wall 26 of the tubular magazine body 21. Follower 60 is slideably moveable upwards and downwards in the magazine 20 for loading and dispensing cartridges. The follower defines a horizontally elongated front portion 60*a* and a vertically elongated rear portion 60*b* extending downwardly from the rear of the front portion. Viewed another way, front portion 60*a* may be considered to be cantilevered from the top end of the rear portion. Rear portion 60*b* has a greater vertical height H2 than the height H1 of the front portion 60*a* (see, e.g., FIG. 25).

Follower 60 includes a front end 61, rear end 62, top 63, bottom 64, and pair of opposed sides 65 extending from front to rear. The top 63 of follower 60 in one embodiment may be defined by a pair of adjoining and angled rear and front cartridge feed ramps 66*a*, 67*a* each respectively defining rear and front cartridge feed surfaces 66, 67. Cartridge feed surfaces 66, 67 are each obliquely angled to each other at angle A3 (sec, e.g., FIG. 22) and longitudinal axis LA when magazine 20 is mounted therein (sec, e.g., FIG. 4B). Angle A3 may be an obtuse angle in some embodiments. Rear cartridge feed surface 66 may be orientated at an obtuse angle to front cartridge feed surface 67 in one embodiment. Front cartridge feed surface 67 defines a top surface of front portion 60*a* of follower 60 whereas rear cartridge feed surface 66 defines a top surface of rear portion 60*b* of the follower.

Figure 25:
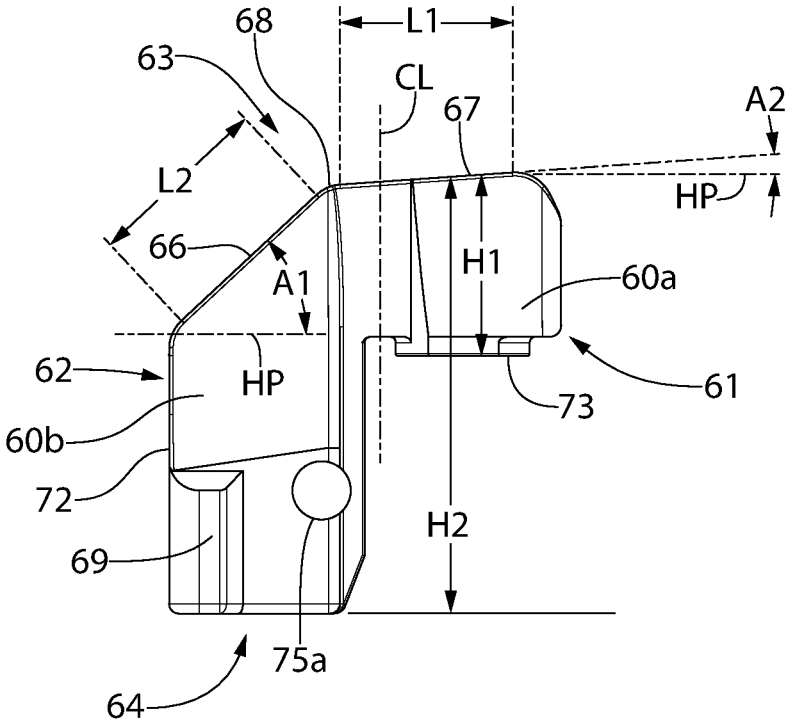
FIG. 25 is a side view thereof.
Figure 26:
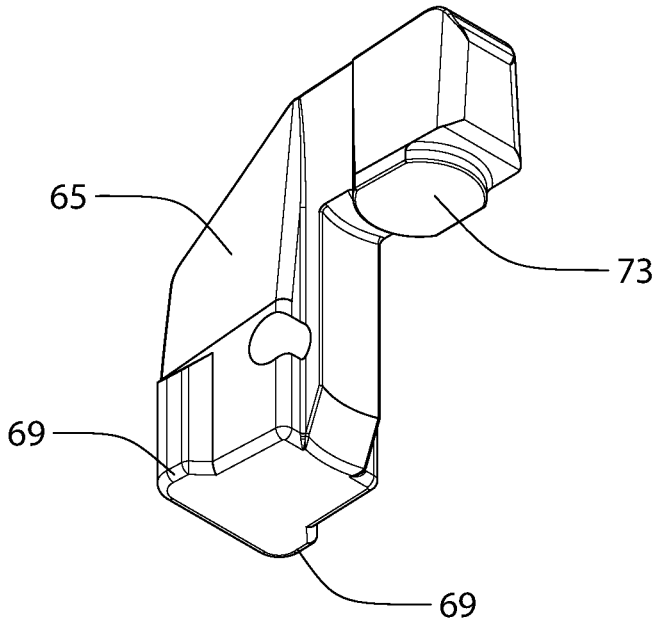
FIG. 26 is a bottom perspective view thereof.
Figure 27:
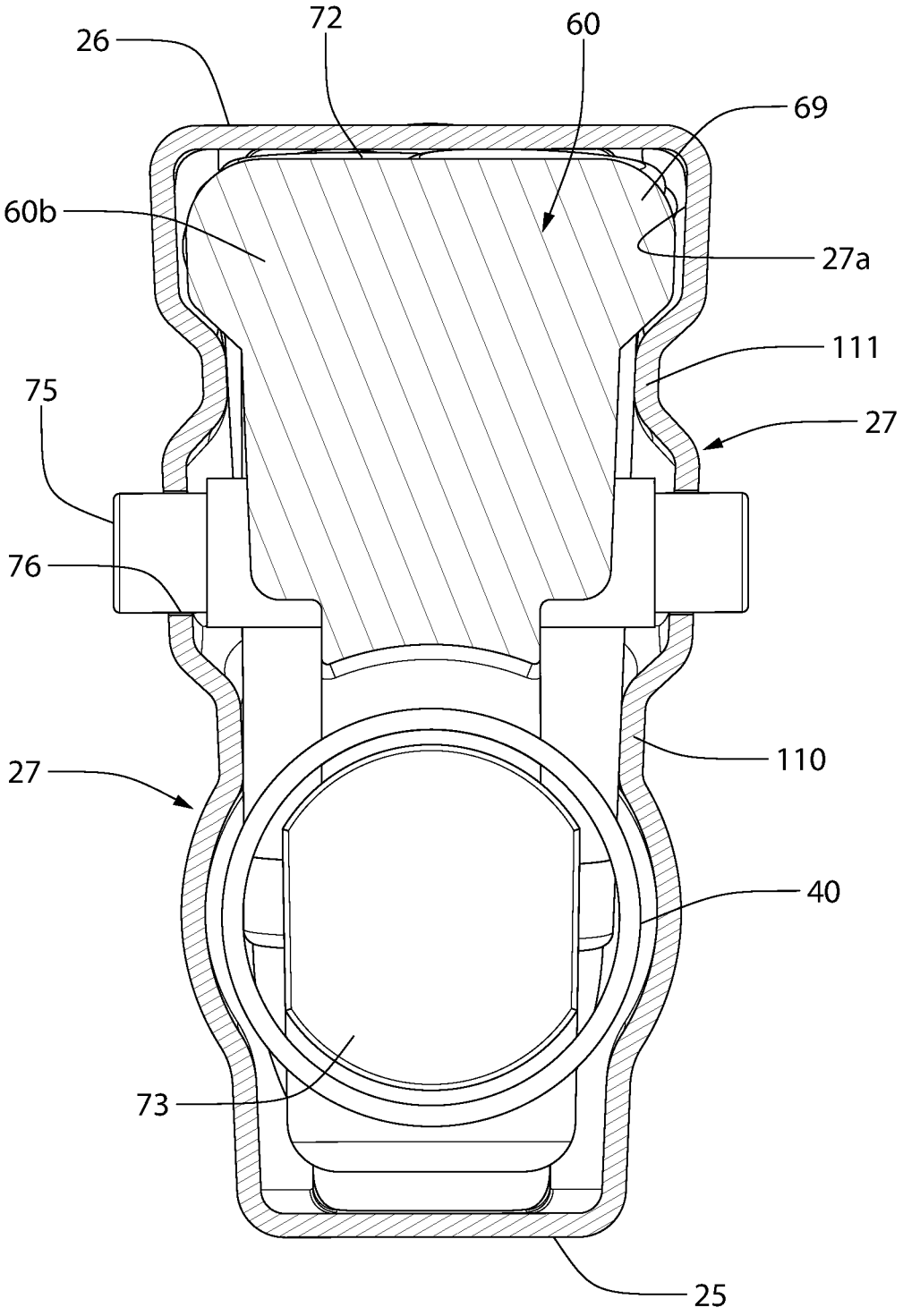
FIG. 27 is a first transverse cross sectional view taken from FIG. 16 looking upwards in the magazine.
Figure 28:
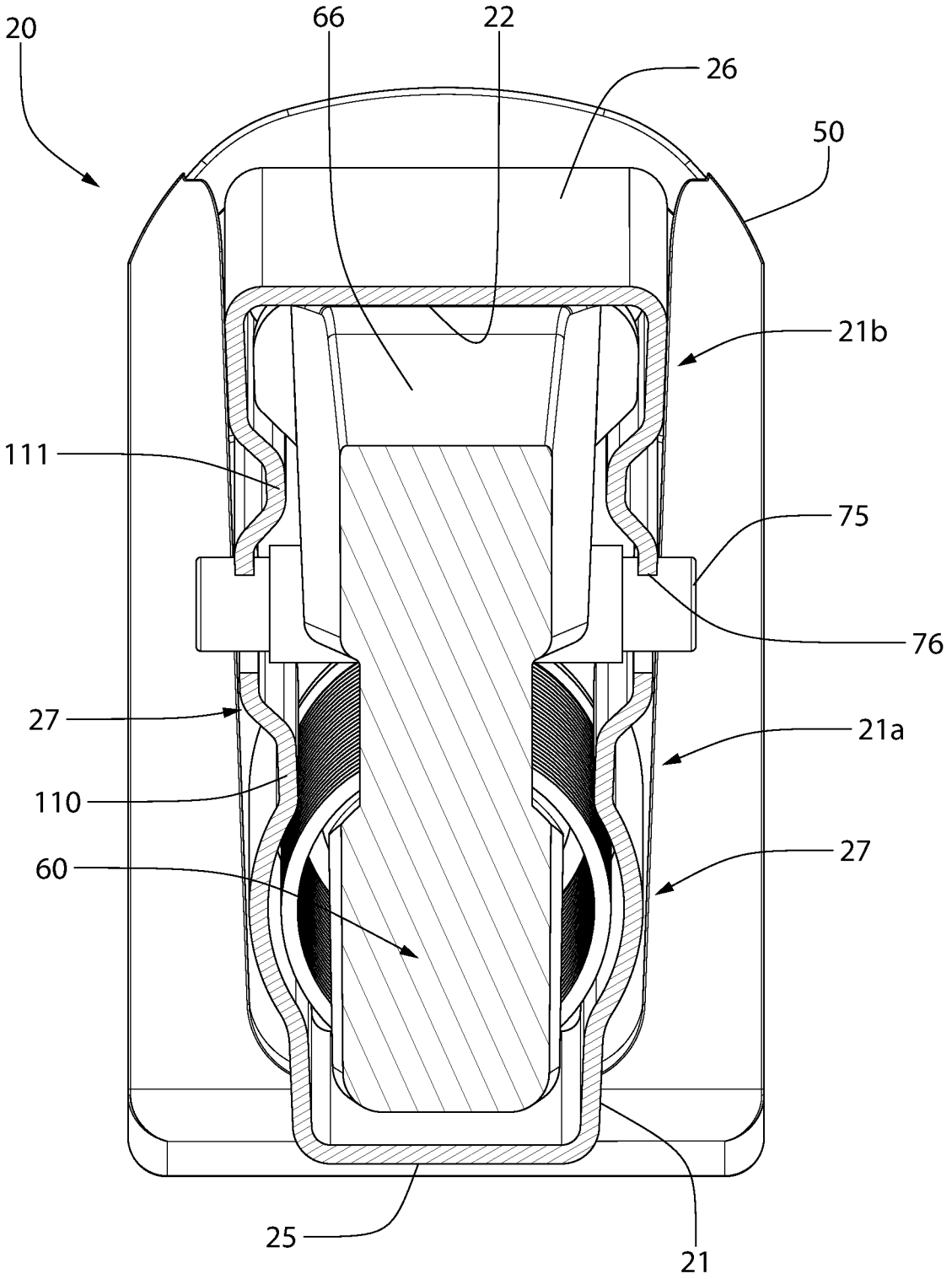
FIG. 28 is a second transverse cross sectional view taken from FIG. 16 looking downwards in the magazine.

Front cartridge feed surface 67 is angled at an angle A2 to a horizontal reference plane HP extending through the tubular magazine body 21 at mid-height of the magazine through its geometric center (see, e.g., FIG. 25). In various embodiments depending on the angle of the magazine well with respect to the longitudinal axis of firearm in which the magazine is to be mounted, angle A2 may be 0 degrees (horizontal) or greater with respect to horizontal reference plane HP. Front cartridge feed surface 67 may therefore be either horizontal or sloped in an upwards direction from rear to front.

Rear cartridge feed surface 66 is angled at an acute angle A1 to horizontal reference plane HP (sec, e.g., FIG. 25). Angle A1 may be substantially larger than angle A2, such as larger than at least four times angle A2, and in some embodiments as shown larger than eight times angle A2. As one example, without limitation, angle A1 may be about 39 degrees and angle A2 may be about 4 degrees for accommodating storage and dispensing of rimmed .22 LR rimfire cartridges. Other angles appropriate for other types of rimmed and rimless cartridges and calibers may be used as needed for other applications. Rear cartridge feed surface 66 may therefore be sloped in an upwards direction from rear to front.

Figure 22:
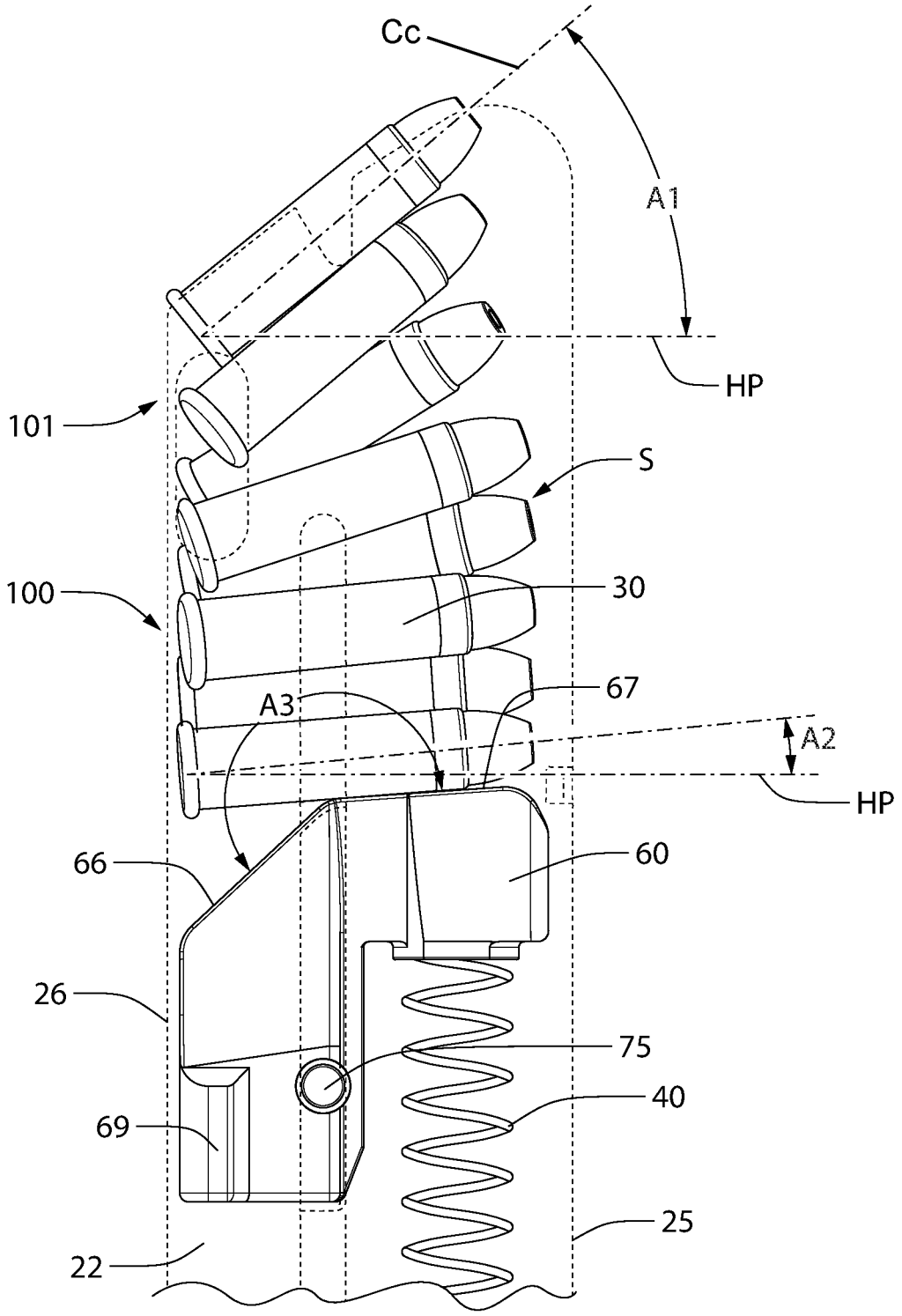
FIG. 22 is a side view of the cartridge feeding mechanism showing the spring-biased magazine follower supporting a stack of cartridges from a second cartridge feed surface and the magazine body shown in dashed phantom lines.
Figure 23:
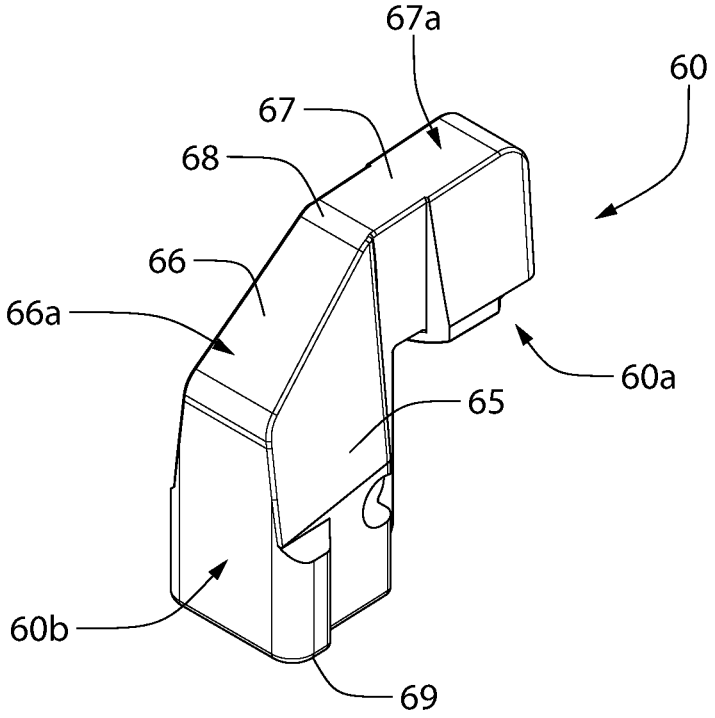
FIG. 23 is a first top perspective view of the follower.
Figure 24:
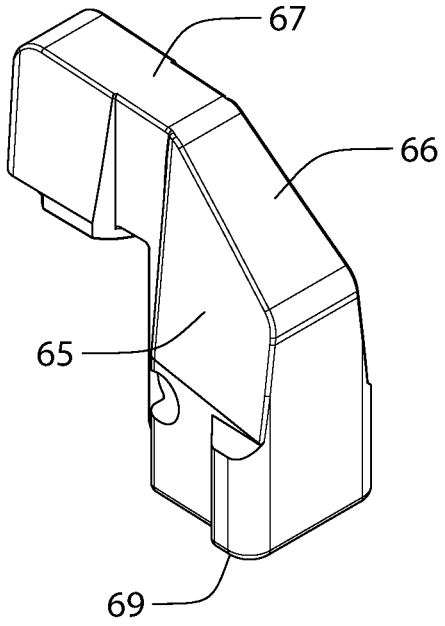
FIG. 24 is a second top perspective view thereof.

In both FIGS. 22 and 25, it bears noting that the horizontal reference plane HP of the magazine has been drawn separately and shown to intersect each cartridge feed surface 66, 67 so as to merely clarify and define the relationship of angles A1 and A2 defines by the feed surfaces to plane HP for convenience of description.

In one embodiment, as illustrated in the figures, both rear and front cartridge feed surfaces 66, 67 may be sloped in an upwards direction. Angles A1 and A2 in such an embodiment may both be positive angles meaning that the front of both the front and rear cartridge feed surfaces 67, 66 defined by feed ramps 67*a*, 66*a* are angled upward from rear to front with respect to the horizontal reference plane HP as shown in FIGS. 22 and 25. Plane HP defines a zero (0) degree horizontal or "x" axis in common mathematical (trigonometric) terms. In other possible embodiments, the front cartridge feed surface 67 may be disposed below horizontal reference plane HP (i.e. sloped downwards from rear to front) and at a negative angle with respect thereto if needed to achieve a proper presentation angle of the cartridge to the firearm depending on the design of the firearm.

The front and rear cartridge feed surfaces 67, 66 alternatingly support the lowermost cartridge 30 in the stack of cartridges in magazine 20 at different times depending on how many cartridges there are in the stack, as further described herein. Angles A1 and A2 of the rear and front cartridge feed surfaces 66, 67 respectively are selected to achieve the proper presentation angle of the uppermost cartridge for feeding into the breech area of the firearm from magazine 20. The firearm includes an angled cartridge feed ramp 120 (see, e.g., FIG. 4B) disposed at the top front of the magazine well 15 at the rear breech end 16*b* of the barrel just below the rear opening to chamber 16*c*. The feed ramp engages the cartridge and raises the front projectile end thereof upwards for chambering by the bolt 18 in the usual manner. Cartridge feed ramp 120 defines a feed angle which is obliquely oriented to longitudinal axis LA as shown.

The front cartridge feed surface 67 and the second cartridge feed surface 66 may each be flat from side-to-side and front to rear in one embodiment. The front cartridge feed surface is configured to engage a front half of the lowermost cartridge in the stack S (e.g., cartridge case 31) when at least one cartridge is present below the transition section 102 in the lower double stack portion 100 of the magazine body 21; and the rear cartridge feed surface is configured to engage a rear half of the lowermost cartridge (e.g., cartridge case 31 and protruding rim 33 at the base thereof) in the stack when there are no cartridges present below the transition section of the magazine body in the lower double stack section. Accordingly, each of the front and rear cartridge feed surfaces 67, 66 have a length measured front to rear along the flat surfaces thereof which is at least 35% of the front to rear depth D1 of the internal cavity 22 within the magazine body 21 which actively holds the cartridges to adequately support the stack at alternate times, as further described herein. Since each cartridge feed surface 67, 66 is intended to support a stack of multiple cartridges at different times under the upward biasing influence of the spring-biased follower 60, the cartridges feed surfaces may each have a length equal to or greater than about 50% of the length L3 of the cartridges in the non-limiting illustrated embodiment (see, e.g., FIG. 20). It bears noting that vertically acting pressure (i.e. compression) is applied to the stack between the uppermost and lowermost cartridge since the stack is squeezed between the follower 60 at bottom and feed lips 28 at the top of the magazine.

An apex 68 is formed at the intersection or juncture between the front and rear cartridge feed surfaces 67, 66. Apex 68 has a generally linear profile side-to-side (see, e.g., FIGS. 23-24) and defines a pivot point about which the lowermost cartridge in the stack of cartridges 30 rotates when cartridge feeding into the breech area of the firearm from the magazine progresses as the number of cartridges are depleted from the magazine via firing the firearm. Apex 68 may be slightly rounded in some embodiments so that an intermediate cartridge 30 in the cartridge stack S can more easily pivot about the apex to transition between support from the front cartridge feed surface 67 to rear cartridge feed surface 66 at a certain point in dispensing cartridges depending on the number of cartridges present in the stack, as further described herein.

The front cartridge feed surface 67 is configured and operable to engage a front/forward portion or half of the lowermost cartridge 30 in the stack when at least one cartridge is present below the transition section 102 of the magazine body 21 in lower double stack section 100 thereof (sec, e.g., FIGS. 16 and 22). Conversely, the rear cartridge feed surface 66 is configured and operable to engage a rear/rearward portion or half of the lowermost cartridge in the stack when there are no cartridges present below the transition section of the magazine (see, e.g., FIG. 20). The front and rear cartridge feed surfaces in one embodiment are configured and operable to exclusively engage the lowermost cartridge in the stack at different times depending on how many cartridges 30 are present in the stack. Accordingly, in the present embodiment, the front cartridge feed surface does not engage the lowermost cartridge in the stack when the rear cartridge feed surface engages the lowermost cartridge in the stack based on a first number of cartridges in the stack, and vice-versa.

Figure 15:
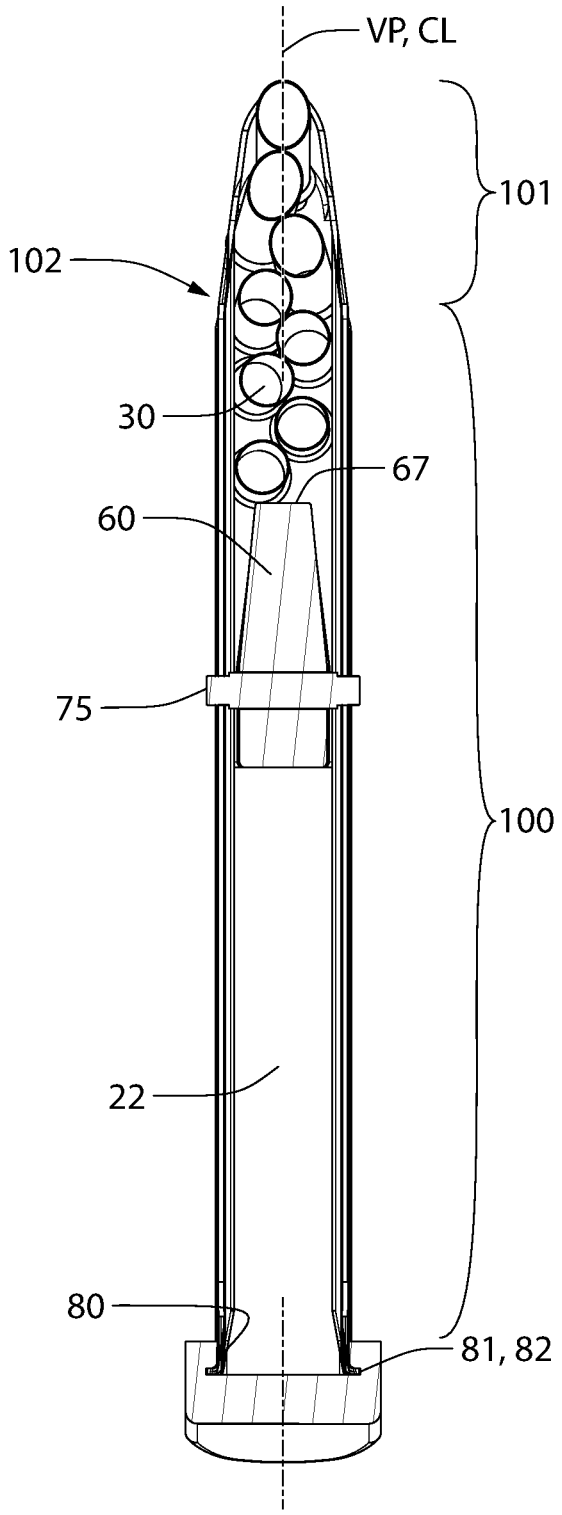
FIG. 15 is a vertical front to rear cross sectional view thereof.
Figure 21:
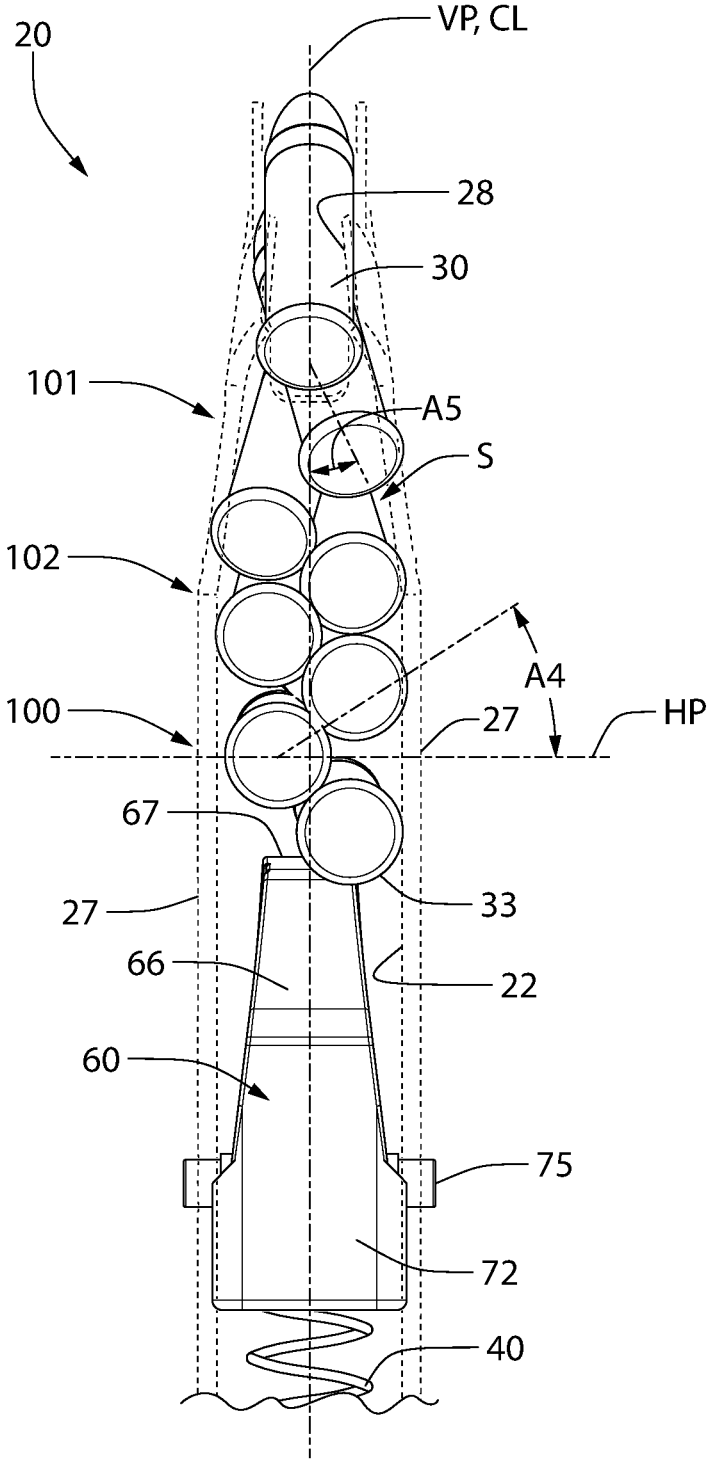
FIG. 21 is forward-looking top perspective view of the magazine with magazine body shown in dashed phantom lines.

When rimmed cartridges 30 are stored in magazine 20, the rims prevent perfect side-by-side nesting between vertically and laterally adjacent cases of cartridges in the stack. As seen in FIGS. 15 and 21-22, the cases of the rimmed cartridges are skewed with respect to one another in the front to rear direction and to the vertical reference plane VP. The cartridges assume a skewed angle A5 (shown in FIG. 21) relative to vertical reference plane VP (a cartridge centerline being defined by the dotted line extending from the projectile end to the base end of each cartridge shown). Only the uppermost cartridge 30 in the stack held in the magazine by the rear feed lips 28 is aligned in-plane with vertical reference plane VP for feeding and chambering in the firearm along the longitudinal axis LA of the firearm (via operation of the front cartridge convergence ribs 110 further described herein) and to be stripped from the magazine by the bolt when the action is cycled to chamber the cartridge (sec, e.g., FIGS. 4A-B and 21). As the stack of cartridges extends from upper single stack section 101 to a point below the transition section 102 into lower double stack section 100, the lowermost cartridge in the stack is supported by only the front cartridge feed surface 67 of follower 60 (sec, e.g., FIG. 22). The uppermost cartridge in the stack of cartridges will be disposed at angle A1 for chambering as shown. The skewed orientation of the cartridges with respect to each other will gradually elevate the front projectile ends of the cartridges in the stack upwards towards the top of the magazine 20. When no cartridges are present in the magazine below transition section 102, angle A1 of rear cartridge feed surface 66 which engages the lowermost cartridge in the stack provides the desired support angle for the cartridge stack to allow proper dispensing of the uppermost cartridge.

Some traditional double stack single feed pistol magazines use a linear guide feature in the upper portion of the magazine to squeeze the front projectile end of the cartridges together for dispensing a single cartridge (i.e. converge the cartridges). Such traditional linear convergence methods are as disclosed for example in U.S. Pat. No. 11,035,635 (see, e.g., FIG. 10 guide ribs 25). These convergence features result in increased upward pressure on the front of the cartridges at the top of the magazine due to the spring-biased action of the magazine follower. A proper degree of upward pressure at the front of cartridges is important to ensure proper presentation of the top round or cartridge to the pistol feed ramp. For rimmed cartridges, proper convergence of double-stacked cartridges in magazines is especially important to achieving a successful cartridge feeding magazine-especially one that employs a steep cartridge feed angle with respect to horizontal.

During development of the present magazine, it was discovered that the rate at which convergence of the cartridges in the upper portion of the magazine occurs as the cartridges advance upwards towards the top discharge opening of the magazine is critical. Traditional linear convergence methods such as that exemplified by U.S. Pat. No. 11,035,635 were tested and proved to be ineffective for reliable feeding of rimmed cartridges under varying cartridge presentation angles A1 at all times without jams; in particular with rimmed .22 LR cartridges. Linear ribs at the front of the magazine had difficulty providing enough support to the top cartridge, such that the nose would not properly present at angle A1. If angle A1 of the top round was not maintained, it would negatively affect feeding; the nose of the cartridge would impact the face of the feed ramp instead of slide up into the chamber of the barrel.

To correct the above rimmed cartridge feeding problems with magazines employing traditional linear convergence features, the magazine body 21 of the present double stack magazine 20 is advantageously provided with a pair of laterally spaced apart non-linear cartridge convergence ribs 110. The present non-linear front cartridge convergence ribs 110 advantageously allow for a faster convergence of cartridges in specific internal areas of the magazine found to be problematic in cartridge feeding to ensure the top round is supported and presents properly at angle A1 for chambering. Ribs 110 are configured and operable to apply inward pressure on the front ends of the cartridges as cartridges move upward in and are dispensed from the magazine. Referring to FIGS. 18A-19 and 27-28, the convergence ribs 110 act on opposing sides of the forward portions of cartridge case 31 on opposing lateral sides thereof to effectively converge and gradually squeeze the stack of rimmed cartridges in the upper single stack section 101 together at the desired rate passing through the transition section 102 from lower double stack section 100. The non-linear cartridge convergence ribs are operable to center the uppermost cartridge in the stack so that it becomes aligned in-plane with the vertical reference plane VP for dispensing into a breech area of the firearm along the longitudinal axis LA to be chambered in barrel 16 by the linear movable bolt 18 each time the action is cycled. Considered another way, the cartridge convergence ribs 110 in the upper single stack section 101 of magazine 20 act to gradually reduce the skew angle A5 of the cartridges as they advance upwards in section 101 until the skew angle of the uppermost cartridge is zero. In some embodiments, the non-linear ribs may alternatively guide the uppermost cartridge to a skew angle A5 other than zero that facilitates feeding from the magazine to the chamber if required by the design of the firearm.

One front cartridge convergence rib 110 may be formed within cavity 22 of the magazine in each lateral sidewall 27 in the upper single feed section 101 and transition section 102. In one embodiment, the non-linear cartridge convergence ribs 110 may be disposed forward of the vertical guide slot 76 in the front half 21*a* of the magazine. Cartridge convergence ribs 110 each project laterally inwardly from the interior of magazine sidewalls 27 into the magazine cavity 22 to engage opposing the sides of the cartridges 30 in the stack S proximate to the middle of the cartridge case 31.

Figure 17:
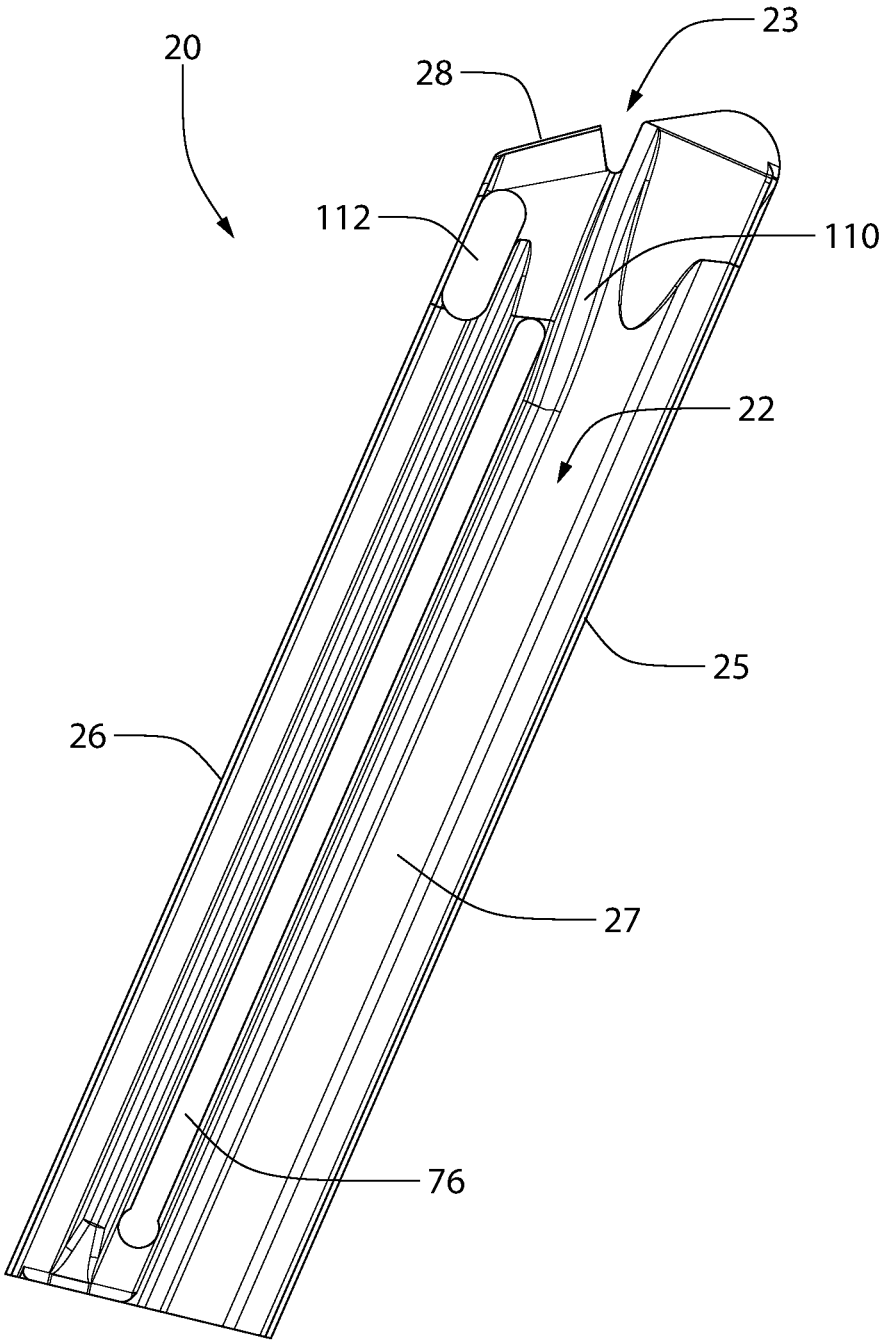
FIG. 17 is vertical cross sectional view of the tubular magazine body alone.
Figure 18A:
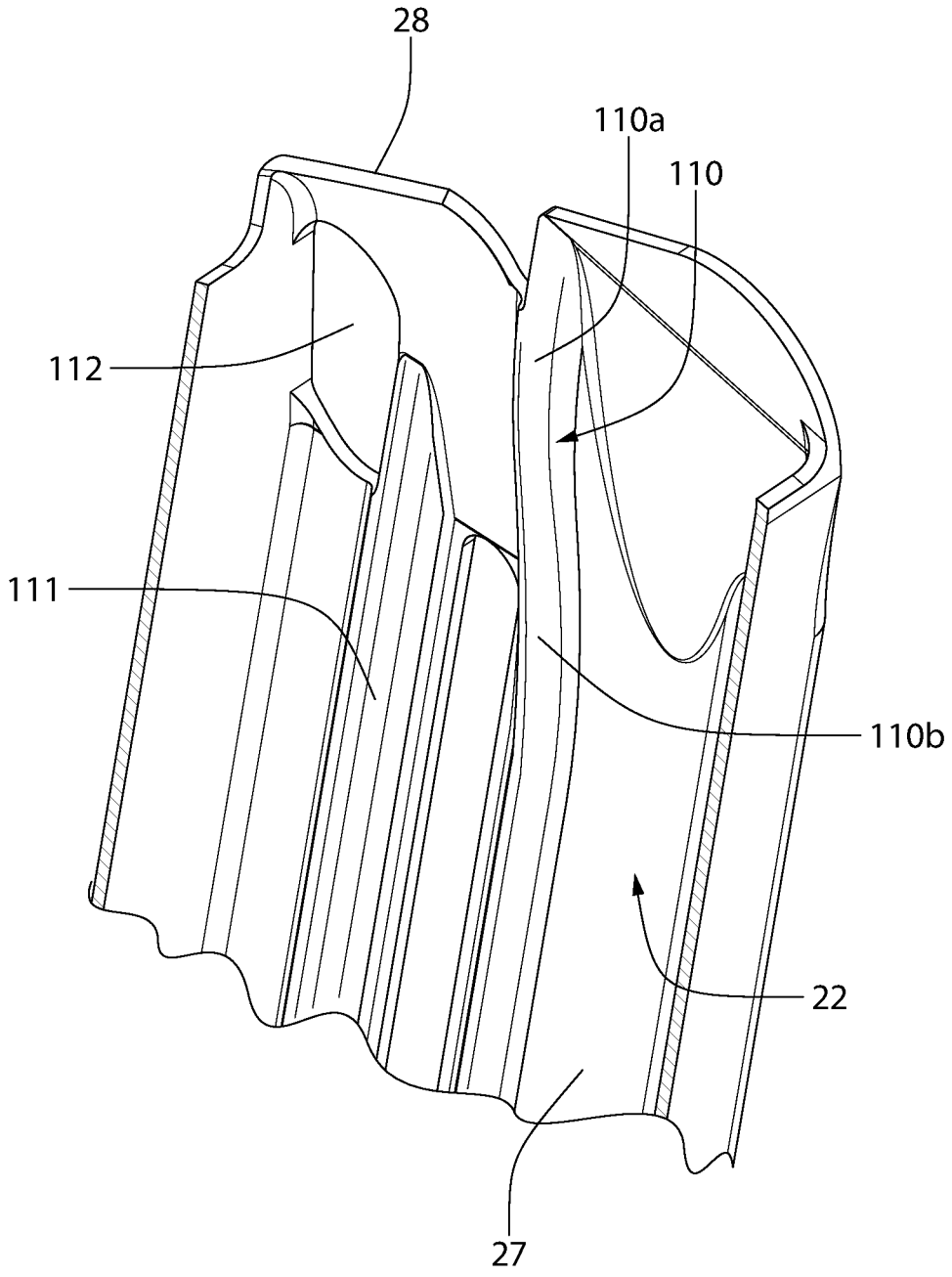
FIG. 18A is a first top cross-sectional perspective view of the magazine body showing details of a front non-linear cartridge convergence rib and a rear cartridge guidance rib inside the cavity of the magazine.
Figure 18B:
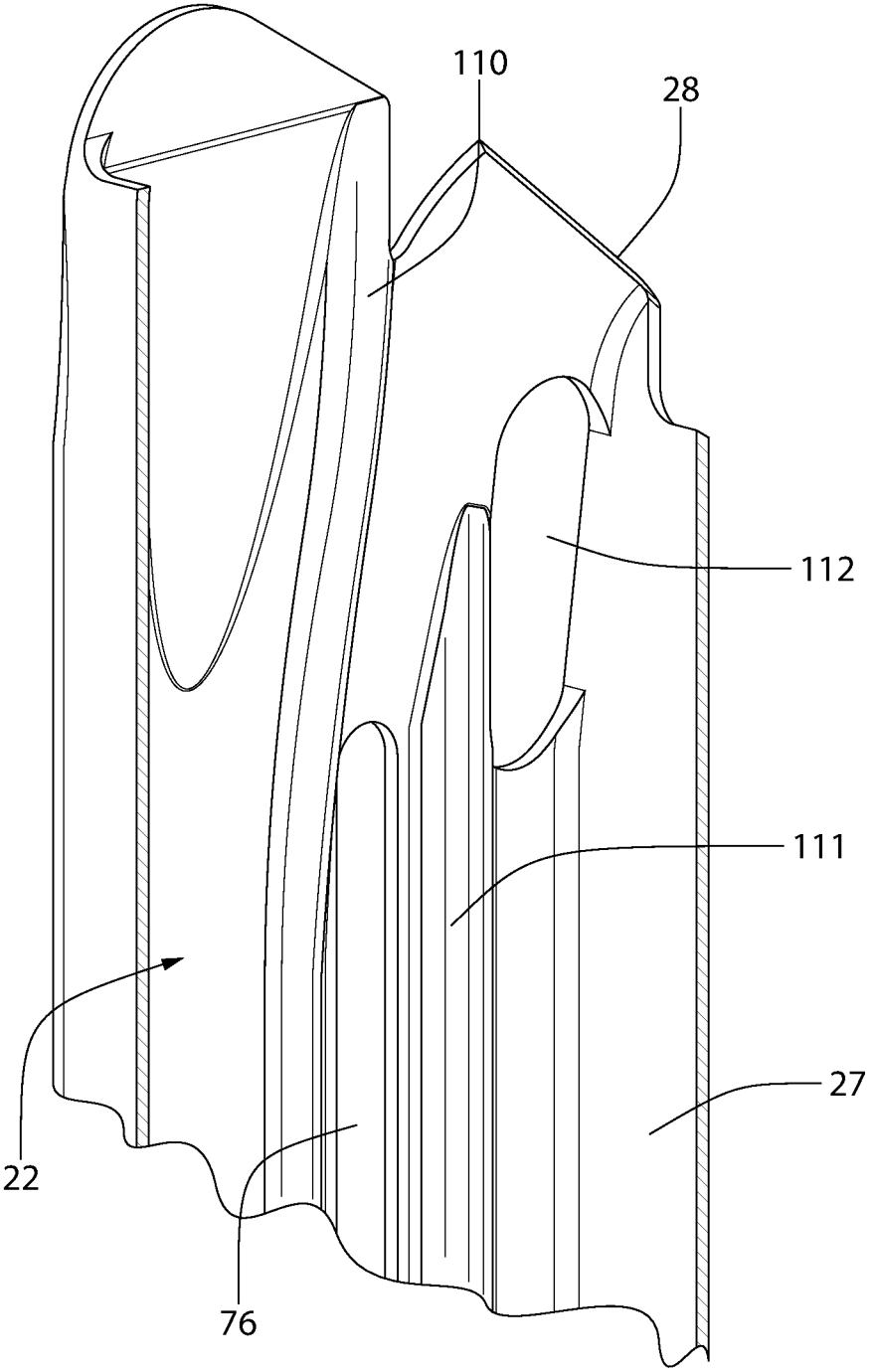
FIG. 18B is a second top cross-sectional perspective view thereof.
Figure 19:
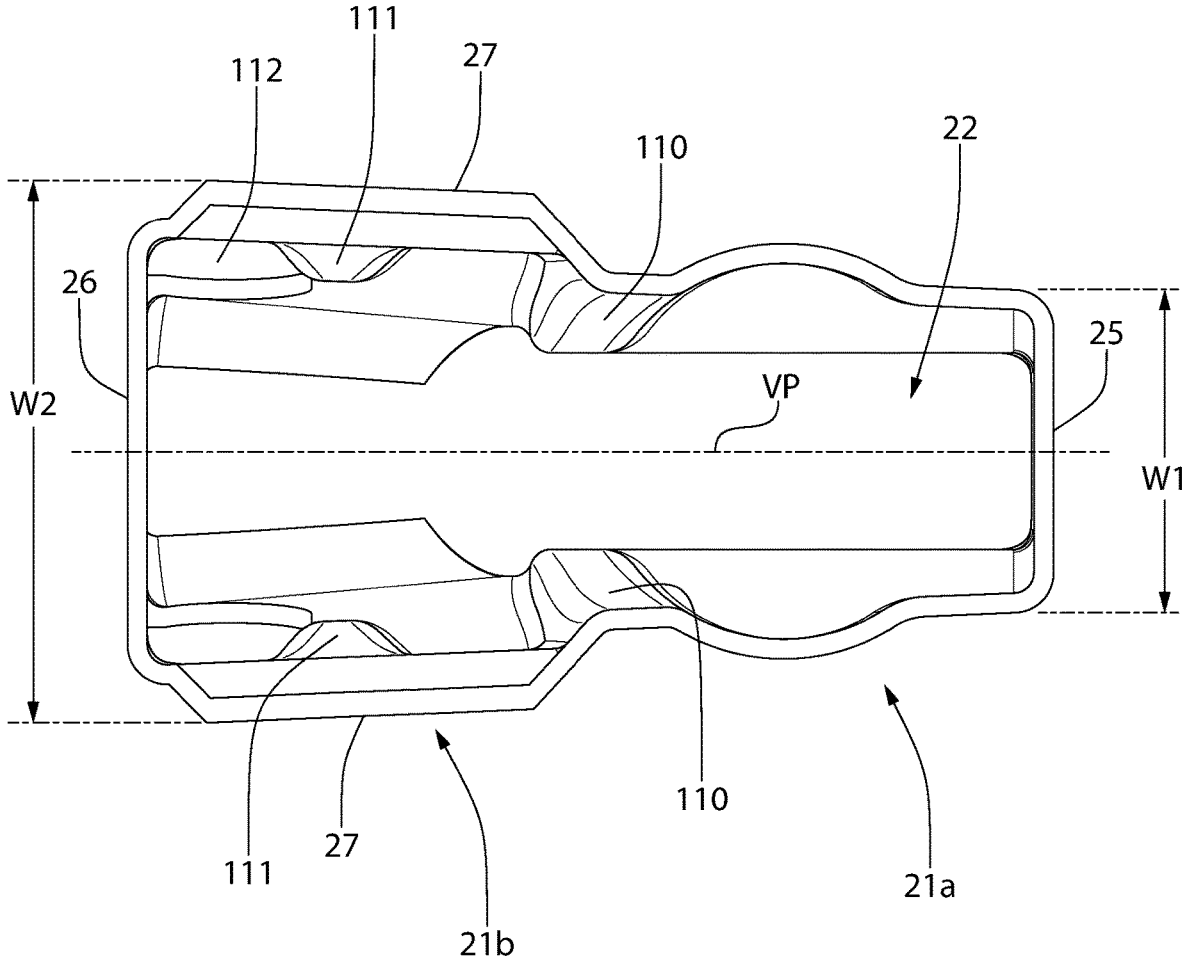
FIG. 19 is bottom view of the tubular magazine body looking upwards towards the top.

In one embodiment, as shown, the non-linear cartridge convergence ribs 110 each may have a arcuately curved configuration including an upper convex portion 110*a* and lower concave portion 110*b* (see, e.g., FIGS. 17-19). These non-linear convergence ribs are thus comprised of two sweeping radii in one embodiment. The two radii of the converge ribs 110 at the front of the magazine are designed to ensure convergence of the tips (i.e.. projectile ends) of the cartridges in the stack occurs at the optimal rate in the upper single stack section of magazine 20 as cartridges are dispensed therefrom by the spring-biased follower 60. It bears noting that FIG. 19 is a view of the magazine 20 looking at the internal cavity 22 from the bottom upwards towards the top end of the magazine body 21. The narrowing of the lateral width between the pair of convergence ribs 110 moving inwards towards the vertical reference plane VP as the ribs converge (but remain spaced apart) at the top of the magazine is evident. To further promote convergence of the cartridges and provide extra lateral width in the rear half 21*b* of the magazine in which the rimmed ends of the cartridges are located, the magazine 20 may have a greater rear width W2 than its front width W1. This additional space provided at the rear of the magazine internal cavity 22 accommodates the front to rear skewed orientation of the cartridges 30 in the magazine attributable to the radially protruding rims 33 at the bases of the cartridges, as further described herein. The concomitant additional rear width provided inside magazine cavity 22 in rear half 21*b* of the magazine provides extra room for skewed outwards rims.

The lateral spacing between the pair of convergence ribs 110 is greatest in the lower concave portion 110*b* of the ribs located in the transition section 102 of the magazine body 21, and narrows as noted above in the upper convex portion 110*b* of the ribs to center the uppermost cartridge in the stack while concomitantly applying the required convergence pressure to the stack in the upper single stack section of the magazine for reliable cartridge feeding. As previously described herein, the cartridge convergence ribs 110 are each configured to engage opposing lateral sides of the cartridge cases 31 to gradually transition and center the cartridges when fed from the lower double stack section into the upper single stack section each time the firearm action is cycled.

Magazine 20 may further include a pair of laterally spaced apart linear cartridge guide ribs 111 formed below the feed lips in the rear half of the magazine 20 (see, e.g., FIGS. 18A-19 and 27-28). The linear guide ribs are configured to engage sides of the cartridges farther rearwards than the non-linear cartridge convergence ribs and prevent the rimmed base area of the cartridges from skewing too far outwards from the vertical reference plane VP (i.e.. center) of the magazine 20. The rear linear guide ribs 111 project inwards into the internal cavity 22 of the magazine to engage the stack of cartridges.

For rimmed cartridges, magazine 20, in one embodiment, may also includes a rim clearance window 112 in each lateral sidewall 27 of the magazine rearward of the rear linear guide ribs 111. The windows provide clearance so that a portion of the rims 33 of the upper cartridges 30 in the stack located in the single stack section 101 of the magazine can protrude partially outwards through the windows (see, e.g., FIG. 5). The linear cartridge guide ribs 111 may be parallel to each other and can extend for substantially the full height of the magazine body 21 terminating below the feed lips 28.

Follower 60 may be a non-rotating design in one embodiment. This means that the follower does not rotate forward/rearward in vertical reference plane VP or laterally about the vertical centerline CL of the magazine when sliding vertically upwards in the magazine 20 to dispense cartridges at the desired presentation angle to the bolt for chambering when the action is cycled. Accordingly, the follower 60 and tubular magazine body 21 of magazine 20 may include one or more mutually cooperating anti-rotation features that guide travel of the follower upwards/downwards in the magazine. These features further act in concert to prevent rotation of the follower inside cavity 22 of the tubular magazine body 21 in the vertical reference plane VP to counteract the unbalanced biasing force imparted to the front portion of follower 60 by the off-center placement of magazine spring 40 in the front half of the magazine as further described herein (sec, e.g., FIG. 16). Advantageously, these anti-rotation features prevent potential follower and cartridge feed jams, thereby providing smooth movement of the follower in the magazine. Follower 60 may thus be considered a non-rotating design in a preferred embodiment due to these anti-rotation features.

Referring to FIGS. 22-26, follower 60 includes a first anti-rotation feature comprising a pair of laterally extending guide protrusions 69 formed proximate to the rear end 62 of the follower on each side. Protrusions 69 extend in opposite lateral directions from the follower farther than other portions of the follower sides 65. Follower 60 in one preferred but non-limiting embodiment may have a monolithic unitary structure and guide protrusions 69 may be formed as an integral unitary part thereof as shown. The guide protrusions each slideably engage a respective inwardly concave portion of the tubular magazine body 21 defining a pair of opposing vertically-extending and elongated guide channels 27*a*. Guide channels 27*a* are formed in each lateral sidewall 27 of the tubular magazine body 21 proximate to rear wall 26 of the tubular magazine body in the rear half of the magazine (sec, e.g., FIGS. 18A-B and 27-28). Guide protrusions 69 and guide channels 27*a* act to prevent both twisting or rotation of follower 60 in the horizontal reference plane HP about the vertical centerline CL of the magazine and to prevent forward/rearward rotation in the vertical reference plane VP of the magazine.

Follower 60 further includes a second anti-rotation feature comprising a downwardly extending and vertically elongated rear stabilizer wall 72. Stabilizer wall 72 may be flat in one embodiment and forms a slideable flat-to-flat interface with the interior surface of rear wall 26 of the tubular magazine body 21 (see, e.g., FIGS. 16 and 27). The stabilizer wall extends downward farther than front portion 60*a* of follower 60 and concomitantly gives rear portion 60*b* of the follower a greater vertical height H2 than height H1 of the front portion (see, e.g., FIG. 25).

To further stabilize upward/downward motion of the follower 60 inside the tubular magazine body 21, follower 60 may further include a third anti-rotation feature comprising a laterally extending guide pin 75. Guide pin 75 has opposing ends which each respectively project into and slideably engage a vertical guide slot 76 formed in each lateral sidewall 27 of the magazine body (sec, e.g., FIGS. 5-7, 15, and 27-28). Guide pin 75 extends through a lateral through hole 75*a* in the follower body passing completely through the follower 60 from side to side (see also FIGS. 22-25). Through hole 75*a* along with the pair of laterally protruding guide protrusions 69 may be formed on rear portion 60*b* of follower 60.

The three anti-rotation features previously described herein act in concert to guide upward/downward movement of the follower in the magazine 20 in a manner which resists both lateral twisting (i.e.. side to side) of the follower in the horizontal reference plane HP and forward/rearward rotation thereof in the vertical reference plane VP. This advantageously provides highly stable and smooth operation of the spring-biased magazine follower to prevent the follower from binding in the magazine body and to prevent cartridge feed jams from the magazine.

Front portion 60*a* of follower 60 on the bottom may further include an upper spring seating protrusion 73 configured to engage and receive the top end of magazine spring 40 (see, e.g., FIGS. 16 and 25-27). Seating protrusion 73 extends downwardly from the underside of the front portion. The bottom end of magazine spring 40 is seated on and engaged by a lower spring seating protrusion 74 disposed on top of floor plate 50. Seating protrusion 74 extends upwardly from a front portion of the floor plate.

As previously described herein, follower 60 may preferably have a monolithic unitary structure in some embodiments in which all of the foregoing features described are integral parts thereof. Follower 60 may be formed of any suitable non-metallic or metallic material for the application. In one embodiment, the follower may be formed of injection molded plastic.

Floor plate 50 of magazine 20 will now be further described. The floor plate has a body that is axially elongated in the direction of the longitudinal axis LA of the magazine 20 when the magazine is mounted to firearm 10. In longitudinal length, floor plate 50 in one non-limiting embodiment may extend from a point rearward of rear wall 26 of the tubular magazine body 21 to a point forward from the front wall 25 of the magazine body resulting in a forward and rearward projection therefrom (sec, e.g., FIGS. 5-12 and 16). In transverse or lateral width, floor plate 50 extends beyond both sidewalls 27 of the tubular magazine body 21. The floor plate defines an upward and rearwardly open receptacle 80 configured to receive the bottom of the tubular magazine body 21 therein for coupling.

Figure 12:
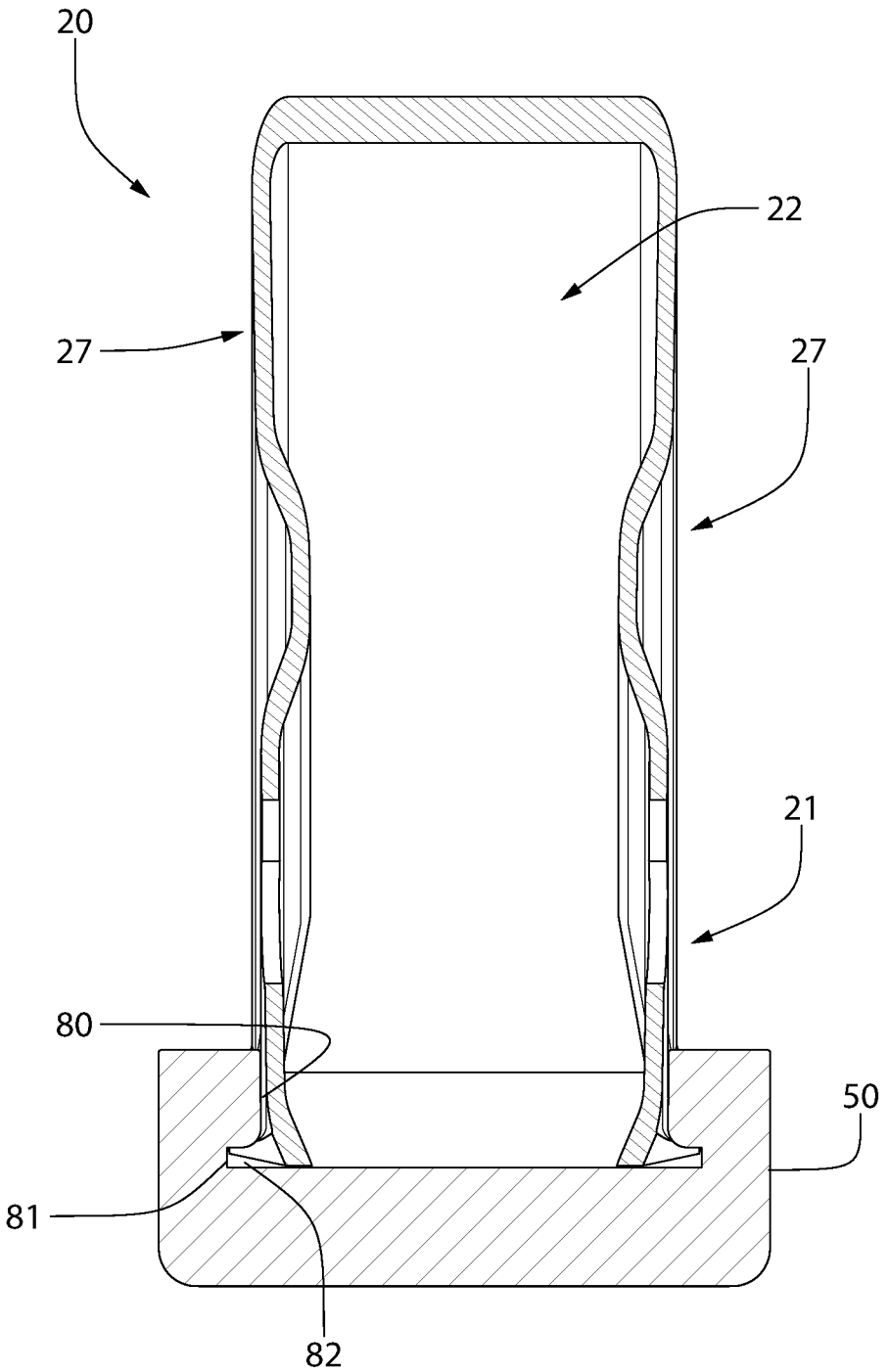
FIG. 12 is a cross sectional view taken from FIG. 10 showing the floor plate to magazine body coupling interface.
Figure 13:
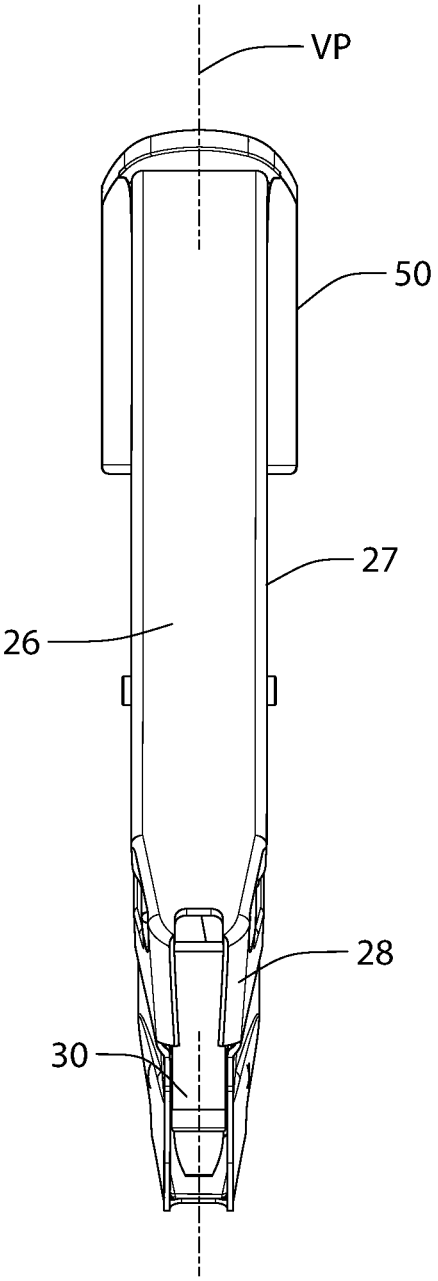
FIG. 13 is a top view of the magazine.
Figure 14:
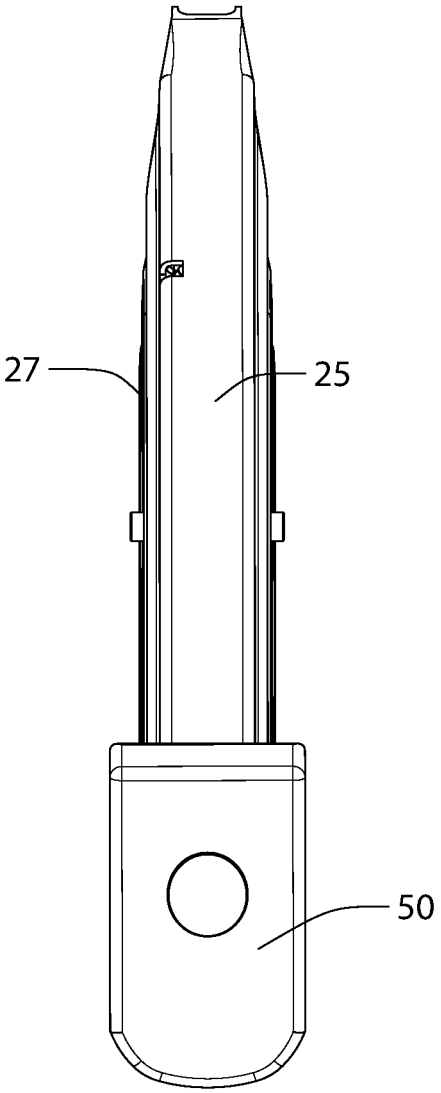
FIG. 14 is a bottom view thereof.

Floor plate 50 may be detachably coupled to the tubular magazine body via any suitable method. As one non-limiting example, floor plate 50 may be slideably and detachably coupled to the bottom end of the tubular magazine body 21. Referring to FIGS. 12 and 16, a pair of opposing inwardly facing and open mounting grooves 81 are formed within receptacle 80 of floor plate 50 which extend for a longitudinal length in the front to rear direction. Grooves 81 slideably receive a pair of outwardly turned mounting flanges 82 formed on the bottom end of the tubular magazine body to couple the floor plate to the magazine. The front of the floor plate defines an upwardly extending stop flange 83 which acts as a travel stop that engages front wall 25 of the tubular magazine body 21 to fix the proper mounting position of the floor plate on the body.

Operation of the magazine and cartridge feed mechanism comprising follower 60 will be further understood with the following description of the method or process for operating a magazine for a firearm.

The method comprises providing a double stack magazine including a top end, a bottom end, a lower double stack section, an upper single stack section, and a transition section formed between the double stack section and the single stack section. The method continues with loading a stack of cartridges 30 into the magazine, wherein the stack comprises a number of cartridges and has a height which extends from the top end 23 of magazine 20 downwards into the lower double stack section 100. Accordingly, there are cartridges of the stack present both above transition section 102 in the upper single stack section 101 and below the transition section in the lower double stack section 100 (see, e.g., FIGS. 15-16 and 21-22). The lowermost cartridge of the stack is supported and engaged by front cartridge feed surface 67 of the follower 60 spring-biased towards the top end of the magazine so long as cartridges are present in the. lower double stack section below the transition section. The lowermost cartridge is disposed at angle A2 (see, e.g., FIGS. 22 and 25). Due to the offset between cartridges in the stack, the projectile ends of the cartridges will gradually become more and more angled upwards moving up in the stack (see, e.g., FIG. 22). The uppermost cartridge in the stack engaged by the magazine feed lips 28 will assume the desired presentation angle (which is equal to angle A1) for proper dispensing and feeding into the breech area of the firearm and chambering in the barrel by the bolt when the action is cycled.

In one embodiment, the magazine 20 may have a capacity for holding 20 rimmed. 22 LR cartridges as one non-limiting example. Other numbers of rimmed cartridges may be loaded in the magazine for use in other firearms depending on the caliber and size of those rounds used.

After the magazine is loaded, the method continues with steps including inserting the magazine 20 into the firearm 10, and feeding cartridges one at a time from the magazine 20 into the firearm in response to discharging the firearm. This gradually reduces the number of cartridges remaining in the stack in magazine 20 with each discharge of the firearm. When there are no more cartridges in the stack occupying the lower double stack section 100 of magazine 20, the lowermost cartridge remaining in the stack will pivot rearwards about apex 68 of the follower (i.e.. cartridge projectile end moving upwards) due to the upwards biasing action of the magazine spring 40 on the follower and engage rear cartridge feed surface 66 which now supports the stack of cartridges from there on up towards the feed lips 28. Front cartridge feed surface 67 therefore no longer engages or supports any portion of the cartridge in one embodiment (see, e.g., FIG. 20). The cartridge stack in the upper single stack section of the magazine is supported solely by the rear cartridge feed surface 66 at angle A1 for proper alignment of the uppermost cartridge with the magazine feed lips 28 and ultimately presentation to the firearm for chambering.

It bears noting that although a single cartridge in upper single stack section 101 is shown in FIG. 20 for simplicity, the lowermost cartridge 30 in the stack will be supported on rear cartridge feed surface 66 in the same manner when there are multiple cartridges in the upper single stack section 101, but no cartridges present in the lower double stack section 100.

The dual cartridge feed surfaces 66, 67 of the follower 60 therefore provides a two-stage non-rotating follower cartridge feed system. As a non-limiting example to further illustrate this concept, for a magazine 20 having a 20 cartridge capacity of .22 LR rimmed cartridges noted above, Stage 1 formed by rear cartridge feed surface 66 is utilized to support cartridges 1-3 in the stack when 3 or less cartridges are present in the magazine (sec, e.g., FIG. 20). Stage 2 formed by front cartridge feed surface 67 is utilized to support cartridges 5-20 in the stack when more than 3 cartridges are present (see, e.g., FIG. 22). When 4 cartridges are present in the magazine, the peak-shaped apex 68 of the follower between front and rear cartridge feed surfaces 67, 66 would engage and support the lowermost 4th cartridge of the stack which lies in the transition section 102 of the magazine. The apex therefore supports the stack when there is a cartridge present in the transition section and upper single stack section 101, but no cartridges remaining in the lower double stack section 100.

It also bears noting that the same foregoing two-stage feed system concept applies and operates in the same manner when magazines are provided with different capacities depending on the caliber and corresponding sizes of rimmed cartridges used.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A double stack magazine for a firearm comprising:

an elongated tubular magazine body defining a vertical centerline and an internal cavity configured to hold a stack of rimmed cartridges, the magazine body including an at least partially open top end, a bottom end, a front wall, a rear wall, and opposed lateral sidewalls extending between the front and rear walls;

the magazine body including a lower double stack section configured to hold a vertically staggered double stack of the cartridges, an upper single stack section, and a transition section formed between the double stack section and the single stack section;

a spring disposed in the cavity;

a follower moveably disposed in the cavity and biased in an upwards direction towards the top end of the magazine body by the spring;

the follower comprising a rear cartridge feed surface and adjoining front cartridge feed surface each configured to selectively engage and support an ammunition cartridge, the rear feed surface being disposed at an oblique angle to the front feed surface ;

the front and rear cartridge feed surfaces each configured to engage and support a lowermost cartridge of the stack at alternate different times depending on a number of cartridges present in the stack.

2. The magazine according to claim 1, wherein the front cartridge feed surface is sloped at a first angle from 0 degrees to about and including 20 degrees with respect to a horizontal reference plane oriented perpendicularly to the vertical centerline of the magazine, and the rear cartridge feed surface sloped in an upwards direction from rear to front at a second angle with respect to the horizontal reference plane which is greater than the first angle.

3. The magazine according to claim 2, wherein the front cartridge feed surface and the second cartridge feed surface are each flat and meet at an apex therebetween.

4. The magazine according to claim 1, wherein the front cartridge feed surface does not engage the lowermost cartridge in the stack when the rear cartridge feed surface engages the lowermost cartridge in the stack, and vice-versa.

5. The magazine according to claim 4, wherein:

the front cartridge feed surface is configured to engage a front half of the lowermost cartridge in the double stack section when at least one cartridge is present below the transition section of the magazine body; and the rear cartridge feed surface is configured to engage a rear half of the lowermost cartridge in the stack in the single stack section when there are no cartridges present below the transition section of the magazine body.

6. The magazine according to claim 1, wherein the transition section comprises a pair of laterally spaced apart non-linear cartridge convergence ribs each having an arcuately curved configuration, the cartridge convergence ribs being configured to engage sides of the cartridges to transition and center the cartridges when fed from the lower double stack section to the upper single stack section.

7. The magazine according to claim 6, wherein the lateral sidewalls are parallel to each other in the lower double stack section and converge towards each other in the upper single stack section moving upwards to the open top end of the magazine body.

8. The magazine according to claim 7, wherein the non-linear cartridge convergence ribs are disposed in a front half of the magazine body forward of a pair of inwardly extending feed lips defined in a rear half of the magazine at the open top end.

9. The magazine according to claim 8, further comprising a pair of laterally spaced apart linear cartridge guide ribs formed below the feed lips in the rear half of the magazine, the linear guide ribs configured to engage sides of the cartridges farther rearwards than the non-linear guide ribs.

10. The magazine according to claim 6, wherein the spring defines a spring axis which is parallel to and offset from the vertical centerline of the magazine body.

11. The magazine according to claim 10, wherein the spring is a helical compression spring comprising a plurality of circular coils collectively defining a diameter of the coils.

12. The magazine according to claim 11, wherein the spring is disposed in a front half of the magazine body and a top end of the spring only engages the follower beneath the front cartridge feed surface.

13. The magazine according to claim 12, wherein the front cartridge feed surface has a length measured between the front and rear walls which is equal to or greater than the diameter of the coils of the spring.

14. The magazine according to claim 1, wherein the lateral sidewalls of the magazine body each include a vertically elongated guide slot, the guide slot slideably receiving a laterally extending guide pin affixed to the follower which cooperate to guide upward and downward movement of the follower in the magazine body in a manner that resists rotation of the follower with respect to the magazine body.

15. The magazine according to claim 14, wherein the follower further comprises a pair of laterally extending guide protrusions each of which slideably engage a respective vertically elongated guide channels formed in each lateral sidewall of the magazine body which further guides upward and downward movement of the follower in the magazine body in a manner that resists rotation of the follower with respect to the magazine body.

16. The magazine according to claim 14, wherein the guide pin and guide protrusions of the follower are each disposed in a vertically elongated rear portion of the follower beneath the rear cartridge feed surface, the rear portion of the follower extending farther downwards in the magazine body than a front portion of the follower which defines the front cartridge feed surface.

17. The magazine according to claim 1, wherein the cartridges are .22 LR rimmed rimfire cartridges.

18. The magazine according to claim 1, wherein only the front cartridge feed surface engages and supports the lowermost cartridge in the stack when there are cartridges present in both the lower double stack section and the upper single stack section, and only the rear cartridge feed surface engages the lowermost cartridge in the when cartridges are present in only the upper single stack section.

19. A pistol comprising a magazine well configured to removably receive the magazine according to claim 1.

20. The magazine according to claim 1, wherein:

the follower comprises a front cartridge feed surface and a rear cartridge feed surface disposed at an obtuse angle to the front cartridge feed surface;

the front cartridge feed surface being configured to engage a lowermost cartridges in the stack when cartridges are present in the lower double stack section of the magazine; and the rear cartridge feed surface being configured to engage the lowermost cartridges in the stack when cartridges are not present in the lower double stack section of the magazine.

21. The magazine according to claim 20, wherein the rear cartridge feed surface is disposed at a first angle to a horizontal reference plane of the magazine and the front cartridge feed surface is disposed at a second angle to the horizontal reference plane, the first angle being larger than the second angle.

22. The magazine according to claim 20, wherein the front and rear cartridge feed surfaces are flat.

* * * * *